US012338577B2

(12) United States Patent
Richardson

(10) Patent No.: US 12,338,577 B2
(45) Date of Patent: Jun. 24, 2025

(54) ROPE EYE SPLICE AND SYSTEMS, APPARATUS AND METHODS FOR FORMING AN EYE IN A ROPE

(71) Applicant: Richardson Capex, LLC, Beaumont, TX (US)

(72) Inventor: Christopher L. Richardson, Beaumont, TX (US)

(73) Assignee: Richardson Capex, LLC, Beaumont, TX (US)

( * ) Notice: Subject to any disclaimer, the term of this patent is extended or adjusted under 35 U.S.C. 154(b) by 587 days.

(21) Appl. No.: 17/462,871

(22) Filed: Aug. 31, 2021

(65) Prior Publication Data

US 2022/0018064 A1 Jan. 20, 2022

Related U.S. Application Data

(63) Continuation-in-part of application No. 17/430,643, filed as application No. PCT/US2019/019589 on Feb. 26, 2019, now abandoned.

(51) Int. Cl.
*D07B 1/18* (2006.01)
*D04C 1/00* (2006.01)

(52) U.S. Cl.
CPC ..... *D07B 1/185* (2013.01); *D04C 1/00* (2013.01); *D07B 2201/1014* (2015.07)

(58) Field of Classification Search
CPC ..... D07B 1/18; D07B 1/185; B66C 1/12
USPC ..... 57/202
See application file for complete search history.

(56) References Cited

U.S. PATENT DOCUMENTS 411,637 A * 9/1889 Batchelor et al. ..... D07B 7/169 228/171
2,299,568 A * 10/1942 Dickey ..... B66C 1/12 87/8
2,413,642 A * 12/1946 Mitchell ..... D07B 1/185 87/8
2,442,175 A * 5/1948 Mitchell ..... D07B 1/185 87/8
2,456,015 A * 12/1948 Orser ..... H01B 7/043 87/8

(Continued)

FOREIGN PATENT DOCUMENTS

GB 702998 A * 1/1954 ..... B66C 1/12
JP H072498 U 1/1995

(Continued)

OTHER PUBLICATIONS

Selfmadesailer, 3-strand splicing 14-California Taper—FInishing your splice, Jan. 16, 2016, YouTube,https://www.youtube.com/watch?v=PpAmJtpwXa4, (last visited Mar. 14, 2024). (Year: 2016).*

(Continued)

*Primary Examiner* — Patrick J. Lynch
(74) *Attorney, Agent, or Firm* — Kelley Drye & Warren LLP

(57) ABSTRACT

Apparatus, systems and methods of forming an eye in a rope are provided. Various embodiments involve a braided splice extending through the entire eye and formed with at least one strand extending through the entire eye toward the forward end of the rope and at least one other strand extending through the entire eye in the opposite direction.

15 Claims, 21 Drawing Sheets

(56) References Cited

U.S. PATENT DOCUMENTS

| | | | | | |
|---|---|---|---|---|---|
| 2,482,204 | A * | 9/1949 | Peterson | D07B 7/169 | 57/202 |
| 2,558,553 | A * | 6/1951 | Hansen | D07B 1/185 | 57/22 |
| 8,707,666 | B2 * | 4/2014 | Crozier | D07B 1/185 | 57/22 |
| 9,340,925 | B2 | 5/2016 | Mozsgai et al. | | |
| 10,669,670 | B2 | 6/2020 | Stout | | |
| 2006/0048494 | A1 | 3/2006 | Wetzel et al. | | |
| 2014/0311118 | A1 * | 10/2014 | Mozsgai | D07B 1/185 | 57/22 |
| 2016/0168787 | A1 * | 6/2016 | Downs | D07B 7/169 | 57/22 |
| 2018/0119342 | A1 | 5/2018 | Stout | | |

FOREIGN PATENT DOCUMENTS

| | | | | |
|---|---|---|---|---|
| JP | 3890341 | B2 | 3/2007 | |
| JP | 2013002010 | A | 1/2013 | |
| KR | 101005170 | B1 | 1/2011 | |
| NL | 2003939 | B1 | 6/2011 | |
| NL | 2017779 | B1 | 6/2018 | |
| WO | WO-2016100390 | A1 * | 6/2016 | D07B 1/185 |
| WO | 2017178484 | A1 | 10/2017 | |

OTHER PUBLICATIONS

Samson Splicing Instructions, 12-Strand Class II Eye Splice, © 2015 Samson Rope Technologies, Inc., 2pp.
Single Braid Eye Splice (Tuck),https://www.teufelberger.com/pub/media/contentmanager/content/downloads/Splicing-Instruction-Single_Braid_Eye_Splice_Tuck_2.pdf, Undated, 2 pp.
12-Strand Single Braid End-for-End Bury Splice, https://www.teufelberger.com/pub/media/contentmanager/content/downloads/Splicing-Instruction-12_Strand_Single_Braid_End_For_End_Bury_1.pdf, Undated, 3pp.
Splicing Instructions Moran 5-4-3 Tuck Splice, © 2015 Cortland Company, Inc., all rights reserved. 16 pp.
Lankhorst Ropes Maritime Ropes Briefing Apr. 2010, 2pp.
Samson Splicing Instructions, 12-Strand Class II Tuck-Bury Splice, © 2017 Samson Rope Technologies, Inc., 3pp.
Samson Splicing Instructions, 12-Strand Class II Eye Splice, Tuck-Bury Splice for Saturn-12, © 2017 Samson Rope Technologies, Inc., 2pp.
Single Braid Eye Splice (Bury), Teufelberger, Undated, 1pp.
Single Braid Eye Splice (Lockstitch), https://www.teufelberger.com/pub/media/contentmanager/content/downloads/Splicing-Instruction-Single_Braid_Eye_Splice_Lock_Stitch_1.pdf, Undated, 1 pp.
Unirope Slingmax, Uni-Lock Flemish Eye Loop Splice for 6-strand wire rope, © 2021 Unirope Ltd., Only, 2 pp.
Yale Cordage High Performance Rope Single Braid Splice, PN 10015112 Rev A 0115, 2 pp.
Yale Cordage S-P-L-I-C-I-N-G Instructions Single Braid Eye Splice, Undated, 3 pp.

* cited by examiner

| Sling Diameter | Rated Capacity - Tons* | | | | | | Sling Dimensions | | | Weights | |
|---|---|---|---|---|---|---|---|---|---|---|---|
| | Vertical | Choker* * 120° | Basket Hitches | | | | | | | | |
| | | | Basket Hitch Legs at 90° | Bridle Sling Legs at 60° | Bridle Sling Legs at 45° | Bridle Sling Legs at 30° | Eye Length (Inches) | Eye Width (Inches) | Minimum Sling Length (Ft.) | Minimum Sling Weight (Pounds) | Weight Per Foot Additional |
| 1/4" | 0.8 | 0.6 | 1.6 | 1.4 | 1.1 | 0.8 | 4 | 2 | 0.88 | 0.023 | 0.017 |
| 5/16" | 1.3 | 1.1 | 2.7 | 2.3 | 1.9 | 1.3 | 5 | 2.5 | 1.09 | 0.044 | 0.026 |
| 3/8" | 1.7 | 1.3 | 3.4 | 2.9 | 2.4 | 1.7 | 6 | 3 | 1.31 | 0.070 | 0.034 |
| 7/16" | 2.2 | 1.8 | 4.4 | 3.8 | 3.1 | 2.2 | 7 | 3.5 | 1.53 | 0.101 | 0.042 |
| 1/2" | 3.2 | 2.6 | 6.4 | 5.6 | 4.5 | 3.2 | 8 | 4 | 1.75 | 0.169 | 0.062 |
| 9/16" | 4.0 | 3.2 | 7.9 | 6.8 | 5.6 | 4.0 | 9 | 4.5 | 1.97 | 0.223 | 0.072 |
| 5/8" | 5.1 | 4.1 | 10.2 | 8.8 | 7.2 | 5.1 | 10 | 5 | 2.19 | 0.347 | 0.101 |
| 3/4" | 5.8 | 4.6 | 11.6 | 10.0 | 8.2 | 5.8 | 12 | 6 | 2.63 | 0.608 | 0.147 |
| 7/8" | 8.5 | 6.8 | 17.0 | 14.7 | 12.0 | 8.5 | 14 | 7 | 3.06 | 0.905 | 0.188 |
| 1" | 9.8 | 7.8 | 19.6 | 17.0 | 13.9 | 9.8 | 16 | 8 | 3.50 | 1.287 | 0.234 |
| 1-1/8" | 13.3 | 10.6 | 26.6 | 23.0 | 18.8 | 13.3 | 18 | 9 | 3.94 | 1.918 | 0.310 |
| 1-1/4" | 14.9 | 11.9 | 29.8 | 25.8 | 21.1 | 14.9 | 20 | 10 | 4.38 | 2.516 | 0.366 |
| 1-3/8" | 18.5 | 14.8 | 37.0 | 32.0 | 26.2 | 18.5 | 22 | 11 | 4.81 | 3.433 | 0.454 |
| 1-1/2" | 20.5 | 16.4 | 41.0 | 35.5 | 29.0 | 20.5 | 24 | 12 | 5.25 | 4.026 | 0.488 |
| 1-5/8" | 25.5 | 20.4 | 51.0 | 44.2 | 36.1 | 25.5 | 26 | 13 | 5.69 | 5.756 | 0.644 |
| 1-3/4" | 30.2 | 24.2 | 60.4 | 52.3 | 42.7 | 30.2 | 28 | 14 | 6.13 | 6.738 | 0.700 |
| 2" | 34.3 | 27.4 | 68.6 | 59.4 | 48.5 | 34.3 | 32 | 16 | 7.00 | 9.042 | 0.822 |
| 2-1/4" | 48.3 | 38.6 | 96.6 | 83.7 | 68.3 | 48.3 | 36 | 18 | 7.88 | 13.79 | 1.115 |
| 2-1/2" | 52.9 | 42.3 | 105.8 | 91.6 | 74.8 | 52.9 | 40 | 20 | 8.75 | 17.68 | 1.286 |
| 2-5/8" | 59.6 | 47.7 | 119.2 | 103.2 | 84.3 | 59.6 | 44 | 22 | 9.52 | 23.04 | 1.534 |
| 3" | 74.9 | 59.9 | 149.8 | 129.7 | 105.9 | 74.9 | 48 | 24 | 10.50 | 31.23 | 1.893 |
| 3-1/2" | 117.0 | 93.6 | 234.0 | 202.6 | 165.5 | 117.0 | 56 | 28 | 12.25 | 56.79 | 2.950 |
| 4" | 181.9 | 145.5 | 363.8 | 313.1 | 257.2 | 181.9 | 64 | 32 | 14.00 | 88.00 | 4.000 |

*Rated Capacities Basket Hitch based on D/d Ration of 12
Rated Capacities based on pin diameters no larger than natural eye width.
Sling Angles less than 30° shall not be used
Choker Capacity based on a 120° angle of choke.
Rated Capacities based only use of Endura12 Rope only

FIG. 4

| Step | Braid | Braid | Braid | Braid | Braid | Braid | Braid | Braid | Braid | Braid | Braid | Braid |
|---|---|---|---|---|---|---|---|---|---|---|---|---|
| | 1 | 2 | 3 | 4 | 5 | 6 | 7 | 8 | 9 | 10 | 11 | 12 |
| 0 | P | P | A | A | P | P | A | A | P | P | A | A |
| 1 | W | P | A | A | P | P | A | A | P | P | A | A |
| 2 | PO | P | A | A | P | P | A | A | P | P | A | A |
| 3 | PO | P | A | W | P | P | A | A | P | P | A | A |
| 4 | PO | P | A | AO | P | P | A | A | P | P | A | A |
| 5 | PO | P | A | AO | W | P | A | A | P | P | A | A |
| 6 | PO | P | A | AO | PO | P | A | A | P | P | A | A |
| 7 | PO | P | A | AO | PO | P | A | W | P | P | A | A |
| 8 | PO | P | A | AO | PO | P | A | AO | P | P | A | A |
| 9 | PO | P | A | AO | PO | P | A | AO | W | P | A | A |
| 10 | PO | P | A | AO | PO | P | A | AO | PO | P | A | A |
| 11 | PO | P | A | AO | PO | P | A | AO | PO | P | A | W |
| 12 | PO | P | A | AO | PO | P | A | AO | PO | P | A | AO |

| | |
|---|---|
| P | Primary |
| A | Alternate |
| W | Withdrawn |
| PO | Primary opposite |
| AO | Alternate opposite |

FIG. 5

ROPE EYE SPLICE AND SYSTEMS, APPARATUS AND METHODS FOR FORMING AN EYE IN A ROPE

CROSS REFERENCE TO RELATED APPLICATIONS

The present application is a continuation-in-part application of and claims priority to U.S. patent application Ser. No. 17/430,643 filed on Aug. 12, 2021 and entitled "Crossover Rope Splice for Creation of Eye", which claims priority to PCT Patent Application No. PCT/US2019/019589, filed on Feb. 26, 2019 and entitled "Crossover Rope Splice for Creation of Eye", both of which are hereby incorporated by reference herein in their entireties.

FIELD OF THE DISCLOSURE

The present disclosure relates generally to a rope having at least one eye formed by one or more spliced connections. In some embodiments, the present disclosure relates to apparatus, systems and method for forming an eye in a rope.

BACKGROUND

Various industries and operations involve the use of ropes having an eye formed at one or both ends, such as for mooring, towing or anchoring ships or floating platforms, slings or winch lines in heavy construction, lifting operations, rescue, etc. The eye, which is often critical to performing the task at hand, is typically formed by looping the end of the rope back onto itself. There are many ways to form the eye, such as with knots, splicing, crimping or gripping members.

Splicing the rope to create the eye is used, for example, in ropes used in heavy tensile or lifting situations. However, the spliced connection for forming the eye can be highly susceptible to damage and can wear out rapidly, leading to failure of the connection. Different splicing techniques have been used, such as, for example, the tuck-and-bury splice, the full splice and the Lankhorst A3 splice. These techniques sometimes involve unwinding or disassembling a length of the rope and then reweaving it back together or returning it back into the body of the rope.

Presently know rope eye splices and splicing techniques are believed to have one or more disadvantages. For example, entirely unwinding or disassembling a length of the rope to form the splice can sacrifice the original integrity, internal configuration, construction and/or strength of the rope at the splice and/or require extensive time and labor. In some instances, an extra component, such as a jacket and/or cover, is required to provide strength, rigidity, support and/or structure to the splice, increasing cost, weight, complexity and maintenance, decreasing handling flexibility and often hiding the splice from view so inspection for damage becomes difficult.

For another example, various known splicing techniques require doubling the rope weight, which increases handling difficulty and cost. In some cases, a significant minimum rope length is required by regulation to form the splice (e.g. 10×rope diameter+2× eye length), substantially increasing weight, cost and manpower for handling the rope. In fact, the minimum required length of various eye splices can consume most of the length of the rope. For yet another example, the appreciably long section of the rope with the splice often also possesses an appreciably diameter or thickness (e.g. 2× rope thickness), increasing rope weight, needed manpower and cost.

Accordingly, there exists a need for an improved rope eye splices and systems, apparatus and methods for forming eyes in rope having one or more of the attributes or capabilities described or shown in the various portions of this patent or as may be apparent therefrom. For example, different embodiments of the present disclosure may help: eliminate the need for a lengthy, thick eye splice normally extending along a substantial portion of the body of the rope; reduce the weight of the rope; reduce or minimize the length of rope needed to make the eye, finished rope or sling; avoid the constraints of required minimum splice lengths; allow the overall length and/or weight of the finished rope (e.g. sling) to be less than ropes having eyes formed with various known splicing techniques; allow greater versatility in the overall size of the finished rope; provide a splice extending primarily through the eye of the rope; integrate the splice within the eye; equalize or evenly distribute the load placed upon the different strands of the splice and rope during use; retain the original rope strand configuration, arrangement and integrity; preserve and maximize rope efficiency (e.g. so there is minimum loss in rope strength due to splicing); strengthen and/or secure the size and position of the eye; provide optimal interconnection, gripping and/or locking of the strands in the splice and eye; distribute load equally among the strands in the rope; distribute load among the strands in the splice in the same manner as the strands in the body of the rope; maintain the original (e.g. braided) structure and configuration of the rope through the splice in the eye; provide all the rope strands in the splice extending through the loop in the same (e.g. braided) arrangement as in the body of the rope; braid the strands in the splice through the entire eye; form a tapered finish; prevent sharp turns or bends of strands in the rope (which could reduce rope capacity and/or become points of weakness); provide a relatively short transition between the eye and body of the rope; provide a tapered transition between the splice and body of the rope for enhanced equalization of load among the strands in the rope and/or to avoid sharp angles or changes in direction in the strands; provide a relatively smooth surface across the transition for ease of handling and improved appearance; produce an eye splice without requiring the removal, separation, unbraiding or disassembling of all the strands in any part of the rope; produce any eye without requiring the use of a jacket or cover over the splice; reduce the manpower and cost needed to form the splice and transport, handle and utilize the finished rope; or a combination thereof.

It should be understood that the above-described examples, disadvantages, limitations, features and capabilities are provided for illustrative purposes only and are not intended to limit the scope or subject matter of this disclosure or the appended claims. Thus, none of the appended claims should be limited by the above discussion or construed to address, include or exclude each or any of the above-cited examples, disadvantages, features and capabilities merely because of the mention thereof above or herein.

BRIEF SUMMARY OF THE DISCLOSURE

In some embodiments, the present disclosure involves a spliced-connection for forming an eye in a rope. The rope is constructed of multiple strands and has forward and rear ends, an eye portion at its forward end, a transition rearward of the eye portion and a body rearward of the transition. The eye portion is used to form the eye. Each strand has respective forward and rear ends. The spliced-connection includes at least a first strand extending through the entire eye portion of the rope in the direction of the forward end of the rope, and at least a second strand extending through the entire eye portion of the rope in the direction of the rear end of the rope. At least one strand, at or near its forward end, is returned into the transition of the rope.

Some exemplary optional features for these embodiments are as follows. If desired, the rope may be unjacketed, multi-strand, single braided rope. Each strand extending through the entire eye portion of the rope in the direction of the rear end of the rope may have been removed from the eye portion of the rope and returned therein in the same path it previously occupied. Half the strands may extend through the entire eye portion of the rope in the direction of the forward end of the rope and half the strands of the rope may extend through the entire eye portion toward the rear end of the rope. At least one strand returned into the transition may help form a tapered finish. The tapered finish may have a length equal to or less than approximately six times the diameter of the rope. At least one strand may be returned into the transition to help form a generally downwardly, rearwardly sloping outer shape of the transition. At least a first strand returned into the transition may extend in the transition toward the body of the rope a first distance, while at least a second strand returned into the transition may extend in the transition toward the body of the rope a greater distance than the first distance. At least the first strand may be tucked into the transition at least once and at least the second strand may be tucked into the transition more times than the first strand.

In various embodiments, the present disclosure involves a spliced-connection for forming an eye in a rope. The rope is constructed of multiple strands braided together, each strand occupying its own unique path in the rope relative to the other strands. The rope includes an eye portion at the forward end of the rope, a transition rearward of the eye portion and a body rearward of the transition. Each strand is originally oriented in the rope in the direction of the forward end of the rope. The spliced-connection includes all the strands of the rope extending through the eye portion of the rope and, at or near their respective forward ends, terminating in the transition. A first plurality of strands extends undisturbed through the eye portion in its original orientation toward the forward end of the rope. A second plurality of strands is reverse-oriented through the eye portion, each such strand having been removed from the eye portion and returned into its original path through the eye portion to face the rear end of the rope.

The present disclosure also includes embodiments of methods of forming an eye in a rope, the rope being constructed of multiple strands and having forward and rear ends, an eye portion at its forward end, a transition rearward of the eye portion and a body rearward of the transition. These methods include reverse-orienting a first plurality of the strands through the entire eye portion of the rope, and leaving a second plurality of the strands undisturbed. Each of the second plurality of strands remaining in their original positions and orientations in the eye portion of the rope. At least one strand, at or near its forward end, is returned into the transition.

Some exemplary optional features for these embodiments are as follows. At least one strand returned into the transition may form the transition with a tapered finish and, in some instances, so the transition has a generally downwardly, rearwardly sloping outer shape. Each strand, at or near its forward end, may be returned into the transition. At least a first strand returned into the transition may extend in the transition toward the body of the rope a first distance, and at least a second strand returned into the transition may extend in the transition toward the body of the rope a greater. At least the first strand may be returned into the transition by tucking it into the transition at least once and at least the second strand may be returned into the transition by tucking it into the transition more times than the first strand. Each of the first plurality of strands may be reverse-oriented by removing it individually from the eye portion of the rope, then returning it into the eye portion in the same path it previously occupied. The first plurality of strands may include half the strands of the rope and the second plurality of strands may include the other half of the strands in the rope. The finished eye may be allowed to remain uncovered and visible for use of the rope.

In some embodiments, the present disclosure involves a sling with at least one eye created by rope with strands reoriented and rethreaded in opposite directions and terminating in the throat of the sling. The sling may be made of a multi-strand rope, where the strands separate at the throat, and then go in opposite directions through the eye, coming back to the throat, where they may be tucked back into the rope, securing the eye.

In various embodiments, a method for involves forming the eye in the rope involves withdrawing a strand up to the central throat section and reintroducing the strand back into or through the distal throat section or distal end of the rope. The rethreaded strand may occupy substantially the same location as it did before, but going in an opposite direction. This process may be repeated, resulting in multiple strands being rethreaded in this manner, creating a splice at least partially in the eye itself.

In certain embodiments, a first primary-oriented strand is pulled out from the rope where the primary-oriented strand distal end is loosened all the way up to the central throat section. The first primary-oriented strand may be pulled out braid by braid until the appropriate amount of the first primary-oriented strand is released in the central throat section. The removal of the first primary-oriented strand creates a void in the rope. The first primary-oriented strand may be rethreaded into the rope back into the void created by the its removal. The first primary-oriented strand distal end may be inserted back into the rope starting at the distal throat section of the rope. Eventually the first primary-oriented strand distal end exits at the central throat section. The primary-oriented strand distal end may then be coupled to the rope. An exemplary method for coupling is known as tucking.

In these embodiments, with the first primary-oriented strand fixed, the process is repeated with a first alternative-oriented strand, whereby the first alternative-oriented strand is pulled out from the rope. The first alternative-oriented strand distal end may be loosened all the way up to the central throat section—pulled out braid by braid until the appropriate amount of the first alternative-oriented strand is released. The removal of the first single alternative-oriented strand creates a void in the rope. The first single alternative-oriented strand may be rethreaded into the void created by its removal. The first single alternative-oriented strand distal end may be inserted back into the rope starting at the distal throat section where it is re-braided. Eventually the first alternative-oriented strand distal end exits at the central throat section. The first alternative-oriented strand distal end may then be coupled to the rope.

In these embodiments, the process with the primary-oriented strands and alternative-oriented strands is repeated until a sufficient number of strands have been rewoven to form an eye. While these embodiments have the primary-oriented strands and alternative-oriented strands filling the void previously occupied, the strands may be threaded back through the eye in any suitable desired way.

In particular embodiments, a sling of braided rope comprises a main rope body having a plurality of strands woven together in a first direction; an eye where at least one of said plurality of strands is woven in a secondary direction; and a throat where said braided rope transitions from said main rope body to said eye; wherein the throat is formed by said at least one of said plurality of strands woven in a second direction coupling to the main body.

Accordingly, the present disclosure includes features and advantages which are believed to enable it to advance rope eye-splicing technology. Characteristics and advantages of the present disclosure described above and additional features and benefits will be readily apparent to those skilled in the art upon consideration of the following detailed description of various embodiments and referring to the accompanying drawings.

BRIEF DESCRIPTION OF THE DRAWINGS

The following exemplary Figures are part of the present specification, included to demonstrate certain aspects of various embodiments of this disclosure and referenced in the detailed description herein:

FIG. 4 is an exemplary sling capacity load chart showing exemplary testing results of the load capacity of slings made of braided synthetic rope having eyes at both ends formed with an exemplary splice in accordance with one or more embodiments of the present disclosure; and FIG. 5 is a chart showing an exemplary alternating pattern of strands for forming an eye splice in a rope in accordance with some embodiments of the present disclosure.

DETAILED DESCRIPTION OF PRESENTLY PREFERRED EMBODIMENTS

Figure 1A:
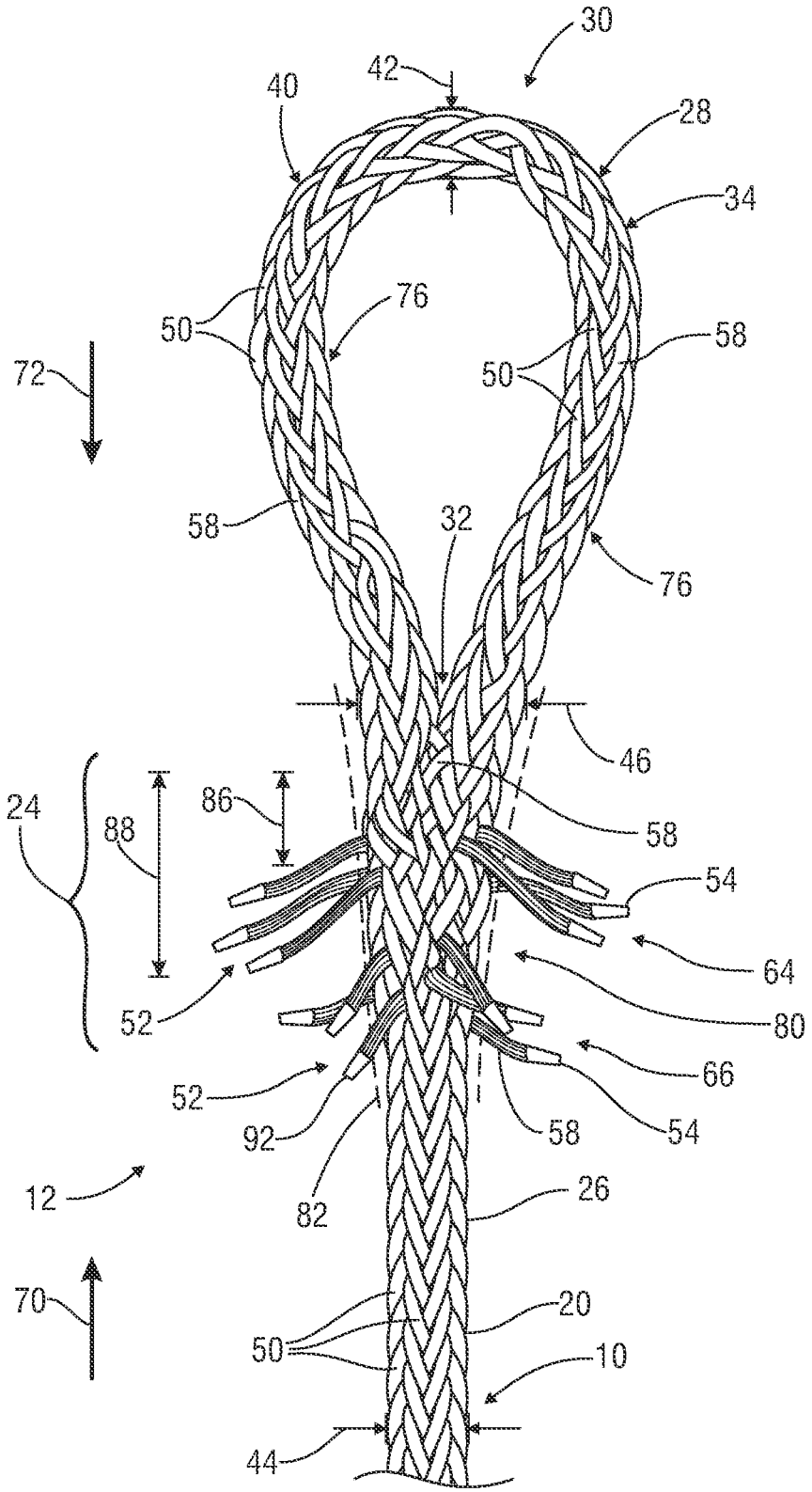
FIG. 1A is a top view of an exemplary rope having an eye formed with a spliced connection in accordance with at least one embodiment of the present disclosure.

Characteristics and advantages of the present disclosure and additional features and benefits will be readily apparent to those skilled in the art upon consideration of the following detailed description of exemplary embodiments and/or referring to the accompanying Figures. It should be understood that the description herein and appended drawings, being of example embodiments, are not intended to limit the claims of this patent (or any patent or patent application claiming priority hereto). On the contrary, the intention is to cover all modifications, equivalents and alternatives falling within the spirit and scope of this disclosure and the relevant claims. Many changes may be made to the particular embodiments and details disclosed herein without departing from such spirit and scope.

In showing and describing preferred embodiments in the appended Figures, common or similar elements are referenced with like or identical reference numerals or are apparent from the Figures and/or the description herein. The Figures are not necessarily to scale and certain features and certain views of the Figures may be shown exaggerated in scale or in schematic in the interest of clarity and conciseness.

As used herein and throughout various portions (and headings) of this patent (including the claims), the terms "invention", "present invention" and variations thereof are not intended to mean every possible embodiment encompassed by this disclosure or any particular claim(s). Thus, the subject matter of each such reference should not be considered as necessary for, or part of, every embodiment hereof, or of any particular claim(s), merely because of such reference.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . ". The use of "(s)" in reference to an item, component or action (e.g. "surface(s)") throughout this patent should be construed to mean "at least one" of the referenced item, component or act. Further, reference herein and in the appended claims to components, feature, actions, aspects, etc. in a singular tense does not limit the present disclosure or appended claims to only one such component feature, action, aspect, etc., but should be interpreted to mean one or more and does not exclude a plurality, except and only to the extent as may be expressly specified otherwise herein or in a particular claim hereof and only for such claim(s) and potentially those claim(s) depending therefrom. The use of expressions like preferably, in particular, especially, typically, etc. is not intended to and should not be construed to limit the present disclosure.

As used throughout this patent, the following terms have the following meanings, except and only to the extent as may be expressly specified otherwise:

The term "and/or" as used herein provides for three distinct possibilities: one, the other or both. All three possibilities do not need to be available—only any one of the three. For example, if a component is described as "having a collar and/or a coupling", some embodiments may include a collar, some embodiments may include a coupling and some embodiments may include both. Since the use of "and/or" herein does not require all three possibilities, a claim limitation herein that recites "having a collar and/or a coupling" would be literally infringed by a device including only one or more collars, one or more couplings or both one or more couplings and one or more collars.

The terms "coupled", "connected", "engaged" and the like, and variations thereof mean and include either an indirect or direct connection or engagement. Thus, if a first component couples to a second component, that connection may be through a direct connection, or through an indirect connection via other components or connections.

The terms "elongated" and variations thereof as used herein mean and refer to an item having an overall length (during the intended use of the item) that is greater than its average width.

The terms "generally", "substantially" and variations thereof, depending upon the context of their use, mean and include greater than 50%.

The terms "operator", "assembler", "manpower", "labor" and variations thereof as used herein refer to and include one or more humans, robots or robotic components, artificial intelligence-driven components/circuitry, other components and the like or the effort thereof.

The terms "rigidly coupled" and variations thereof mean connected together in a manner that is intended not to allow any, or more than an insubstantial or minimal amount of, relative movement therebetween as is expected during typical or expected operations. In other words, if components A and B are rigidly coupled together, they are not movable relative to one another (more than a minimal or insubstantial amount) during typical or expected operations.

It should be noted that any of the above terms may be further explained, defined, expanded or limited below or in other parts of this patent. Further, the above list of terms is not all inclusive, and other terms may be defined or explained below or in other sections of this patent.

Referring initially to FIG. 1A, a rope 10 is shown having an eye 30 formed at one end 12 thereof with the employment of a spliced-connection, or splice, 40 in accordance with one or more embodiments of the present disclosure. In this example, the rope 10 is a multi-strand, single-braid, synthetic rope 20 without a core, jacket or cover. However, the present disclosure is not limited to use with multi-strand, single-braid synthetic rope 20. In fact, the rope 10 may have any desired form, construction, configuration and operation. Likewise the rope 10 may be designed or used for any desired purpose and in any arrangement or configuration of components. For example, an eye 30 can be formed at both ends of the rope 10 and used as a sling (e.g. sling 16, FIG. 3) for dragging, lifting and/or anchoring. Thus, the nature, type, use or other details of the rope 10 are not limiting upon the present disclosure or appended claims, except and only to the extent as may be expressly specified otherwise herein or in a particular appended claim and only for such claim(s) and potentially those claim(s) depending therefrom.

Figure 1B:
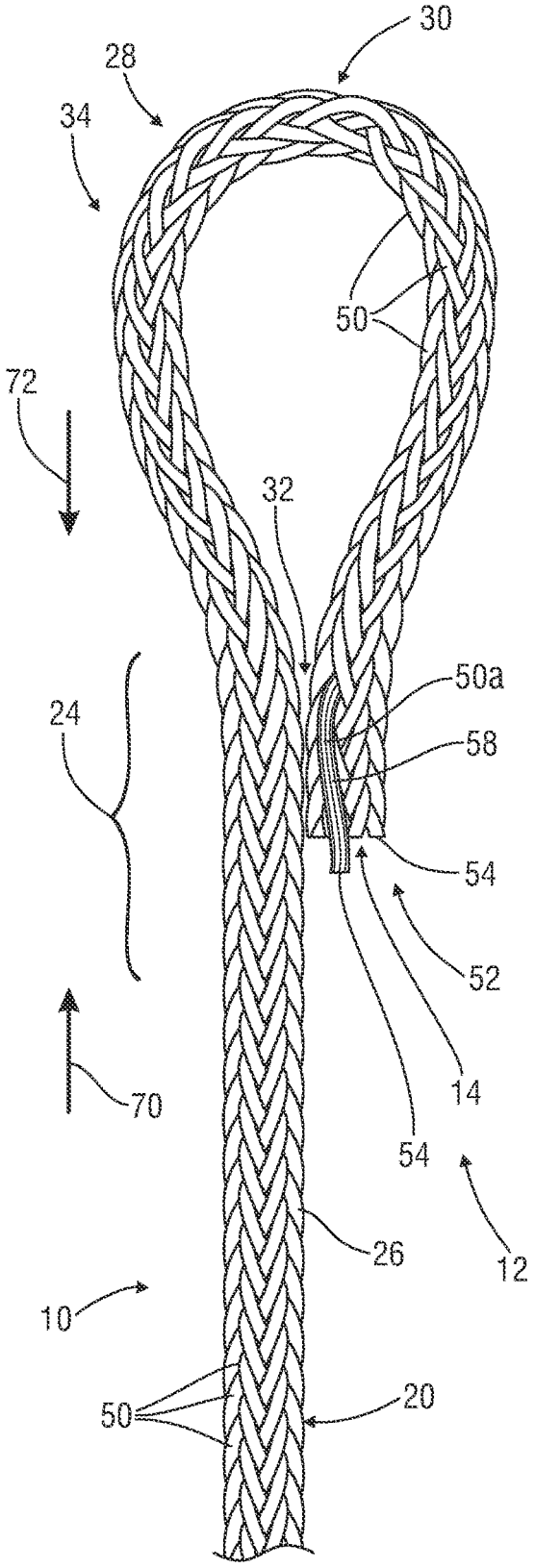
FIGS. 1B-1N are top views of the exemplary rope of FIG. 1A at sequential different exemplary stages in at least one embodiment of a process for forming the exemplary spliced connection shown in FIG. 1A.

Referring now to FIGS. 1A-1B, for the purposes of this description, the illustrated eye 30 is referenced herein as being formed at the forward end 12 of the rope 10. (The absolute end of the rope 10 at its forward end 12 is referred to herein as the forward tip 14 of the rope 10.) The other end (not shown) of the rope 10 would be referred to as the rear end of the rope 10. As a point of reference, the tip of the generally "V" shape formed inside the exemplary eye 30 (where the two sides of the exemplary eye 30 merge together and may touch or meet) is referred to as the intersection 32. The general area where the two sides of the eye 30 merge together and the eye 30 merges with, or into, the illustrated rope 10 is referred to as the transition 24 (where the rope 10 transitions into the eye 30). Thus, the exemplary eye 30 and intersection 32 are forward of the transition 24. The remainder of the illustrated rope 10, rearward of the transition 24, is simply referred to herein as the base, or body, 26 of the rope 10, which may have any desired configuration, features and uses. The portion, or length, of the exemplary rope 10 that makes up (e.g. and resides in) the eye 30 is sometimes referred to herein as the eye portion 28 of the rope 10 or the loop 34 of the eye 30.

Still referring to FIGS. 1A-1B, the rope 10, as is and becomes further known in the art, is made up of and formed by at least two elongated members 50 (e.g. typically extending through its length), which are grouped together in any desired manner, each having its forward tail, or end, 52 at the forward end 12 of the rope 10 (and its forward tip 54 at the forward tip 14 of the rope 10). The elongated members 50 of the rope 10 may have any form, configuration and construction. For example, the elongated members 50 could be threads, rope strands, individual ropes, cords, wires, strings, twines, cables, strings, yarns, plies, fibers, tubes or the like, or a combination thereof and could include one or more core components, and may be constructed of any desired natural or synthetic material or a combination thereof (e.g. polyester, polyamide, polyethylene, polypropylene, high modulus polyethylene, polyaramide, ultra-high molecular weight polyethylene, aramid, Kevlar, Dyneema, steel, etc.). Thus, the name, nature, construction and configuration of the elongated members 50 is not limiting upon the present disclosure or any appended claims, except and only to the extent as may be expressly specified otherwise herein or in a particular appended claim and only for such claim(s) and potentially those claim(s) depending therefrom. For the purpose of this patent, the elongated member 50 is referred to herein as a "strand" 50 of the rope 10. Accordingly, the terms "elongated member", "strand" and variations thereof refer to and include one or more threads, rope strands, individual ropes, cords, wires, strings, twines, cables, yarns, plies, fibers, tubes, core members or the like, or a combination thereof and constructed of any desired material or a combination thereof.

The illustrated rope 10 is formed with twelve strands 50 braided together (e.g. commercially available twelve-strand, single-braided synthetic rope 20 with six strands braided to the left and six strands braided to the right), but could have fewer (e.g. 2-11) or more (13-n) strands 50 arranged in any design configuration (e.g. not braided, double braided, etc.). For example, the rope 10 may be constructed of any combination of natural or synthetic materials and may be any type of single or multi-strand rope (e.g. 3, 6, 8, 12 or more or less strand), may be single, double or otherwise multi-braded, twisted, helically wrapped, spirally arranged, spun, woven, plaited non-stranded or have otherwise interrelated or interconnected elongated members or at least substantially parallel elongated members, include a jacket and/or cover with or without a core. As used herein, the terms "rope" and variations thereof thus refer to and include an assembly or grouping of least two elongated members (of any desired nature, type and construction), grouped, arranged or configured in any desired manner pattern or configuration (e.g. braided, twisted, wound, woven, laced or strung together, grouped in parallel, etc.). It should be noted that, in the appended drawings, all twelve strands 50 of the exemplary rope 10 may not be visible or shown precisely accurately positioned or braided together. As such, the appended drawings are not meant to reflect the actual number and braiding of the strands 50 in the exemplary rope 10.

Referring specifically to FIG. 1A, in accordance with the present disclosure, the splice 40 may have any suitable form, configuration, construction, operation and location. In some embodiments, the splice 40 includes part of at least some strands 50 of the rope 10 and extends through at least part of the loop 34 of the eye 30. Depending upon the embodiment, this can be done to help eliminate the need for a lengthy, thick eye splice normally extending along a substantial portion of the body 26 of the rope 10, reduce the weight of the rope 10 and the length of rope 10 needed to make the eye 30, minimize the length of the finished rope (e.g. sling), allow greater versatility in the overall size of the finished rope 10, equalize load share among the strands 50, for any other purpose(s) or a combination thereof. The illustrated splice 40 includes all the strands 50 of the rope and extends through the entire loop 34 (the entire eye 30). In some embodiments, the splice 40 may also extend into the transition 24, if desired, such as to help equalize load share among the strands 50, for any other purpose(s) or a combination thereof. In other embodiments, the splice 40 may include less than all the strands 50, not extend through the entire loop 34 of the eye 30, not extend into the transition 24 or a combination thereof.

Still referring to FIG. 1A, the exemplary eye splice 40 may be formed at least partially in the loop 34 of the eye 30 in any suitable manner. In some embodiments, the splice 40 may include at least one section 58 of at least one strand 50 of the rope 10 that is reversed in direction in at least part of the loop 34 of the eye 30. Such a section 58 of a strand 50 is sometimes referred to herein as a reverse-direction strand section 58. As used herein, the terms "reverse" and variations thereof in the context of the position, direction or orientation of a strand of rope, or a strand section, mean such strand or strand section has been separated, or removed, from at least part of the rope and returned back into part of the rope facing or travelling opposite the direction it previously faced or travelled. The terms "separated" and variations thereof, as used herein in the general context of a strand, strand section or other part of a rope being separated from the rope, refer to and include being at least partially withdrawn, unbraided, untwisted, unwound, unwoven, unstrung, untucked, unlaced, disconnected or the like, or otherwise at least partially removed or extracted. The terms "returned" and variations thereof, as used herein in the general context of a strand, strand section or other part of a rope being returned into the rope, refer to and include being at least partially braided or re-braided, woven or rewoven, threaded or rethreaded, twisted or retwisted, wound or rewound, tucked or re-tucked, strung or restrung, laced or relaced, united or reunited, oriented or reoriented, inserted or reinserted, interconnected, coupled, guided and the like.

Depending upon the embodiment, one or more strands 50 may be reversed in direction to help retain the original rope strand configuration, arrangement and integrity, maintain the original strength and form of the rope 10, form, preserve and maximize rope efficiency, provide optimal interconnection, gripping and/or locking of the strands 50 in the splice 40 and eye 30, distribute load equally among the strands 50 in the rope 10, for any other purpose(s) or a combination thereof. For example, the reverse-direction strand section 58 of at least one strand 50 may be removed, or separated, from the desired part of the rope 10 and then coupled to, or returned back into, the rope 10 in the opposite direction (e.g. FIGS. 1B-1N). In other words, if the subject exemplary reverse-direction strand section 58 is characterized as having originally extended through the rope 10 travelling or facing in the forward direction (arrow 70)—from the body 26 of the rope 10 to the forward tip 14 of the rope 10, it may be returned into the rope 10 travelling or facing in the rearward direction (arrow 72). The terms "original", "original-direction" and variations thereof when used in reference to the direction of a strand, or strand section, of a rope mean and refer to the direction the strand, or strand section, faced or traveled before the rope was altered to form the splice. The original direction of the strands 50 in the exemplary rope 10 is described herein as the forward direction or toward the forward end of the rope. In accordance with various embodiments of the present disclosure, one or more strands 50 of the rope 10 that are retained in their original direction may be referenced as "original-direction strands."

Still referring to FIG. 1A, in some embodiments, one or more of the reverse-direction strand sections 58 of at least one strand 50 of the rope 10 may be returned back into the rope 10 (e.g. into the loop 34) at least partially in the same precise voids, spaces, location or path (generally indicated as path 76, FIG. 1I) it previously occupied in the rope 10. Depending upon the embodiment, this may be employed, for example, to help maintain the original (e.g. braided) structure and configuration of the rope 10 through the splice 40 in the eye 30, provide all the rope strands 50 in the splice 40 extending through the loop 34 in the same (e.g. braided) arrangement as in the body 26 of the rope 10, preserve and maximize rope efficiency and integrity so there is minimum loss in rope strength due to splicing, provide optimal interconnection, gripping and/or locking of the strands 50 in the splice 40, distribute load equally among the strands 50 in the rope 10, for any other purpose(s) or a combination thereof. For example, one or more strands 50 may be separated from the rope 10 starting from the forward tip 14 (e.g. FIG. 1B) of the rope 10 for any desired length (e.g. the full length of the loop 34 and part of the transition 24, FIG. 1I) and then returned into the path 76 it previously occupied (e.g. through the loop 34 and back into the transition 24).

In another independent aspect of the present disclosure, separate from reverse-orienting one or more strands 50 of the rope 10 such as described above, one or more strands 50 of the rope 10 may, if desired, be returned into the rope 10 in and/or rearward of the eye 30. Depending upon the embodiment, this may be done to help equalize or evenly distribute the load placed upon the different strands 50 of the splice 40 and rope 10 during use, optimize the interconnection, locking and/or gripping of the strands 50 in the splice 40, form a tapered finish 80, for any other purpose(s) or a combination thereof. For example, one or more strands 50, at or proximate to its respective forward end 52, may be returned into the rope 10 rearward of the intersection 32 (e.g. after the splice 40 is formed or to finish the splice 40).

In some instances, the strands 50 may be returned into, and help form, the transition 24. In the present embodiment, all (e.g. twelve) strands 50 are returned into the transition 24. For example, each strand 50 of the rope 10, at or proximate to its forward end 52, may be tucked into rope 10 at the transition 24. As used herein, the terms "tuck" and variations thereof refer to and mean to pass the strand over one or more other strands of a rope and then under one or more other strands of the rope. It should be noted that any tucks shown in the appended drawings are not intended to appear precisely correct in location, configuration and orientation. However, any other technique (other than tucking) may be used to return one or more strands 50 (e.g. at or proximate to its forward end 52) into the rope 10, if desired. In other embodiments, the forward end 52 (or other portion) of only some or none of the strands 50 may be returned into the rope 10.

The precise methodology used for separating and returning a strand 50, strand section 58 or other part of the rope 10 into the rope 10 is not limiting upon the present disclosure or appended claims, except and only to the extent as may be expressly specified otherwise herein or in a particular appended claim and only for such claim(s) and potentially those claim(s) depending therefrom. Further, it should be noted that, in the appended drawings, the precise paths and positions of the strands 50 and strand sections 58 (e.g. that are separated from and/or returned into the rope 10) relative to other strands 50, strand sections 58 and other parts of the rope 10 are not necessarily accurate. As such, the appended drawings are not meant to reflect the actual braiding, or interrelationship of strands, of a splice 40 made in accordance with the present disclosure.

In the illustrated embodiment, the splice 40 and eye 30 are thus formed having some strands 50 of the rope 10 maintained in their original positions and orientations (e.g. undisturbed), and other strands 50 removed and returned (e.g. one at a time so as not to otherwise disturb the braided configuration and relationship of the other strands 50 in the rope 10) through the loop 34 of the eye 30 in the opposite direction. Also in this embodiment, the forward ends 52 of all the exemplary strands 50 are coupled to or extended into the transition 24. Thus, the exemplary splice 40 includes the strands 50 of the rope 10 travelling in opposite directions through the loop 34 of the eye 30 and returned into the rope 10 at the transition 24. However, the present disclosure is not limited to this specific arrangement. For example, some strands 50 used to form the splice 40 may not extend all the way through the eye 30 and/or some strands 50 may not start in and/or be returned into the transition 24 or may start or be returned at a different location.

Referring still to FIG. 1A, in some embodiments, it may be desirable to taper the thickness of the rope 10 in one or more regions (e.g. somewhere between the eye 30 and body 26 of the rope 10). As used herein, the terms "taper" and variations thereof mean and refer to a stepped, sloped or tapered overall outer shape that varies from at least a first thickness to at least a second different thickness. For example, the transition 24 may possess a thickness 46 that is up to approximately twice the thickness 44 of the rope 10 (e.g. when the transition 24 effectively includes double the number of strands 50 of the rope 10, FIG. 1P). Thus, the thickness of the rope 10 may vary by 100% between the transition 24 and body 26 of the rope 10 (rearward of the transition 24). In some instances, it may be desirable to form the transition 24 (or other part of the rope 10) with a generally stepped, sloped or tapered outer shape, sometimes referred to herein as a tapered finish 80. In such embodiments, the tapered finish 80 could extend across the entire length of the transition 24.

In some embodiments, the outer shape of the transition 24 may be tapered downwardly, rearwardly to the body 26 of the rope 10 to form the tapered finish 80. An example general outer shape of the exemplary tapered finish 80 at least partially across the transition 24 is shown with broken lines 82. The tapered finish 80 may be provided in any suitable manner. For example, if one or more exemplary strands 50 are returned into the transition 24, such as described above and/or below, all or some of those strands 50 (e.g. returned into the transition 24 differing distances) may help form the tapered finish 80. Depending upon the embodiment, a tapered finish 80 may be provided to help equalize load among the strands 50 of the rope 10, prevent sharp turns, angles, bends or changes of direction of the strands 50 in and around the splice 40 (which could reduce rope capacity and/or become points of weakness), provide a relatively smooth surface across the transition 24 for ease of handling and improved appearance, for any other purpose(s) or a combination thereof. However, in other embodiments, the transition 24 may not possess a thickness 46 that is twice the thickness 44 of the rope 10 and/or there may be no need or desire to taper the thickness of any parts of the rope 10.

Figure 3:
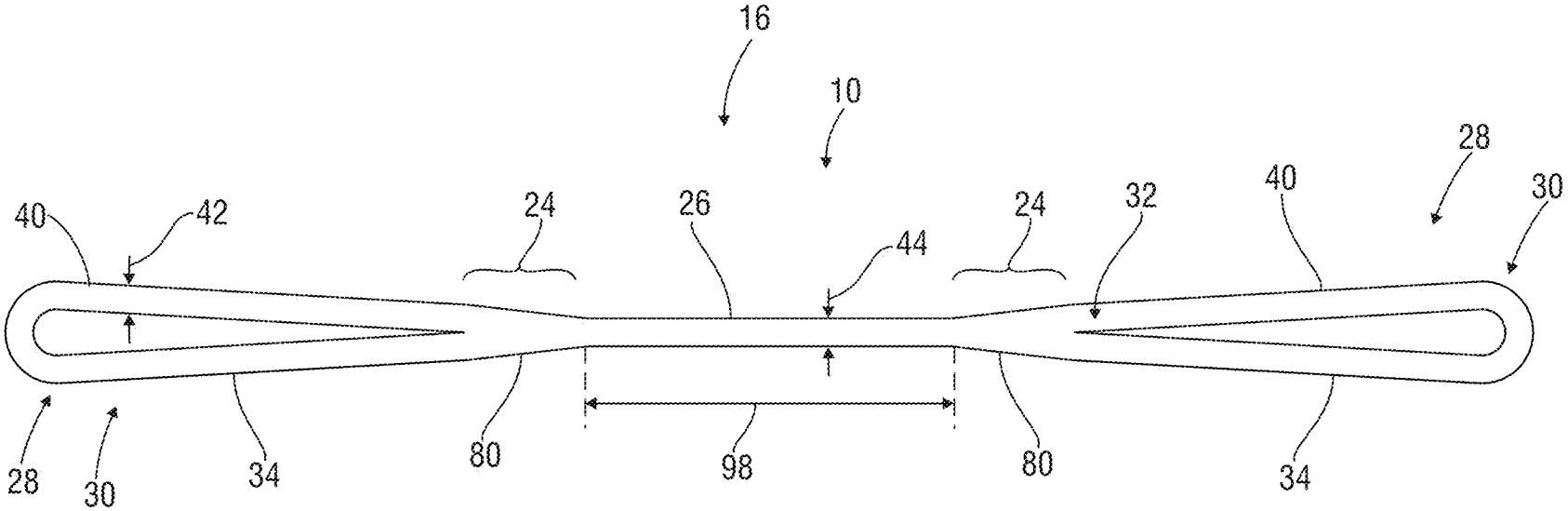
FIG. 3 is a top view of an exemplary sling having eyes constructed with exemplary splices in accordance with one or more embodiments of the present disclosure.

In another independent aspect of the present disclosure, the exemplary transition 24 (and the tapered finish 80 across the transition 24, when included), may be formed having any desired length. The length of the transition 24 may depend upon one or more variables, such as whether it is tapered (aka the tapered finish 80), the size of the eye 30, type and thickness of the rope 10, but will typically be substantially less than the length of the presently known conventional eye splices that extend rearward of the eye 30. For example, the length of the transition 24 may be approximately between two and eight times (or more or less) the thickness 44 of the rope 10. In the embodiment of FIG. 3, the length each illustrated transition 24 with tapered finish 80, measured from a point rearward of the corresponding intersection 32 to the beginning of the body 26 of the rope 10, is approximately four times the thickness of the rope 44. However, the present disclosure is not limited to the above exemplary dimensions or other details, except and only to the extent as may be expressly specified otherwise herein or in a particular appended claim and only for such claim(s) and potentially those claim(s) depending therefrom.

Some exemplary methods of forming a splice 40 in accordance with the present disclosure will now be described with reference to FIGS. 1B-1P. Referring to FIG. 1B, typically, the eye portion 28 of the rope 10 is measured, or determined, and may be wrapped in a loop that will generally define the eye 30. In these embodiments, at least one strand 50*a* of the rope 10 is identified to be at least partially reverse-oriented in at least part of the eye portion 28 of the rope 10. For the reader's convenience, the exemplary strand 50*a* is shown highlighted and exaggerated in size in at least some of the appended drawings.

The strand(s) 50 may be reverse-oriented in at least part of the eye 30 in any suitable manner. Still referring to FIG. 1B, in this example, the first strand 50*a* may be loosened, such as starting at or near the forward tip 14 of the rope 10. As shown in FIGS. 1C-1H, part of the illustrated first strand 50*a* in then separated from the rope 10 as desired. This may be done in any suitable manner and for any desired distance or length. Starting with FIG. 1D and through FIG. 1H, the illustrated strand 50*a* is backed out, or unwoven, from the rope 10 at least partially through the length of the eye portion 28 in the direction 78, such as with the use of a fid (not shown or required).

Figure 1C:
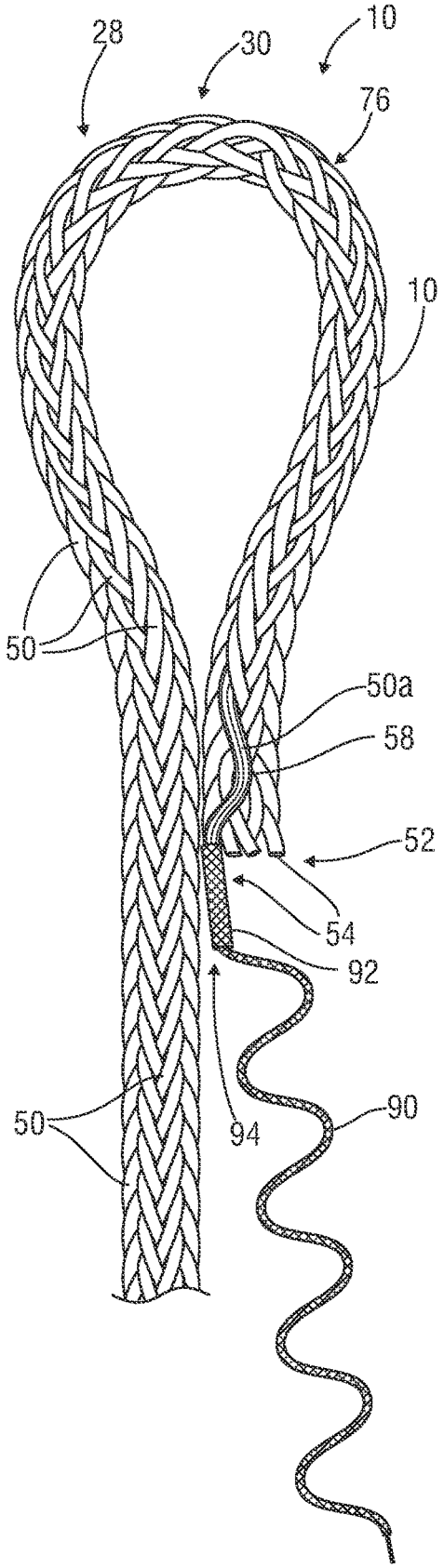
Figure 1D:
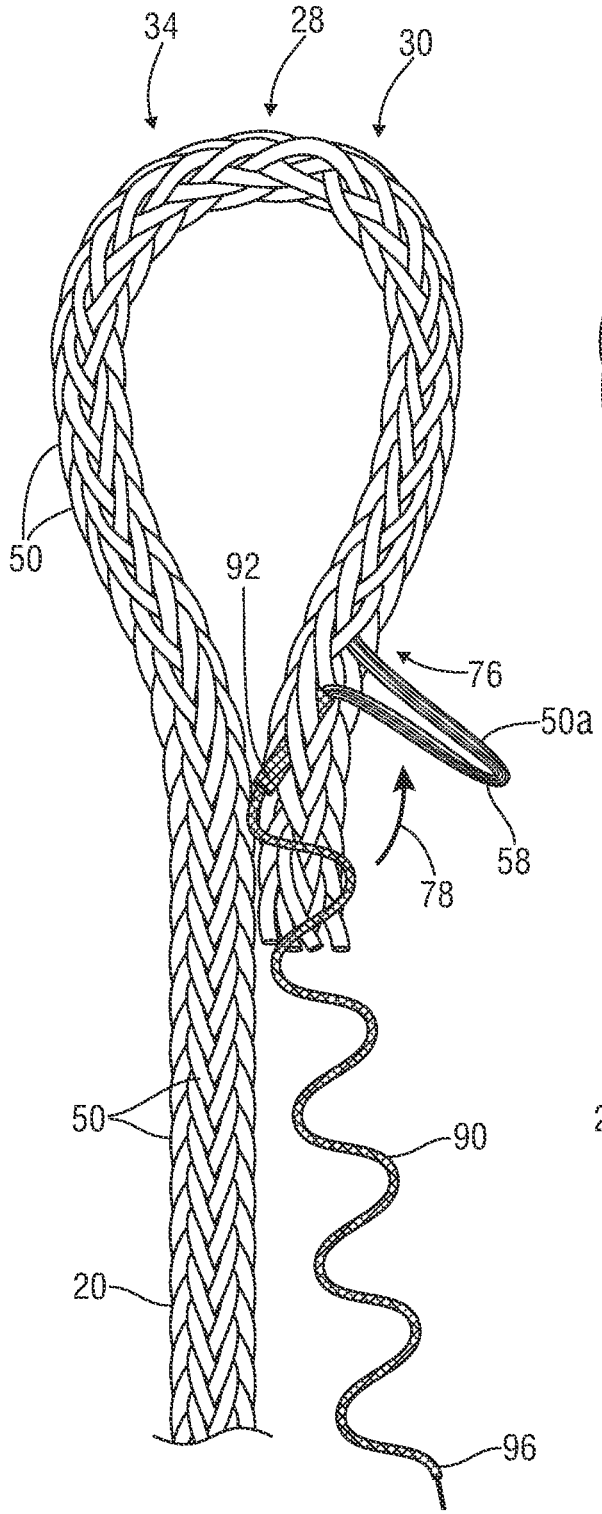
Figure 1E:
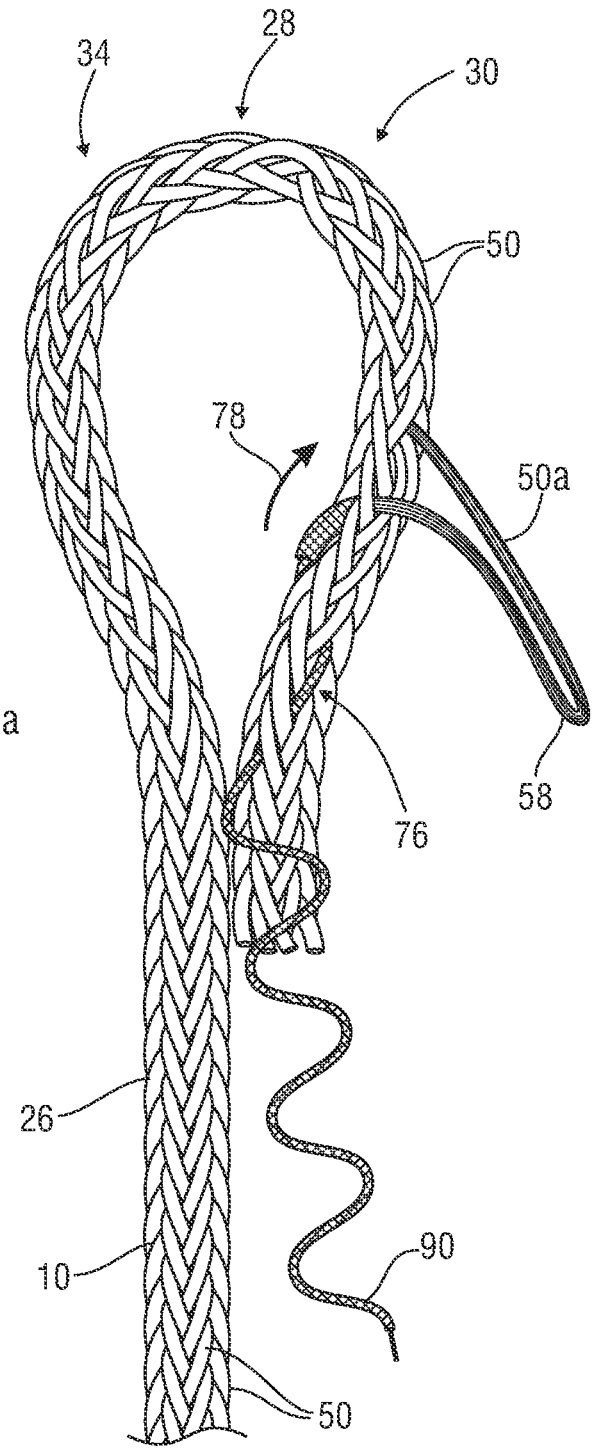
Figure 1F:
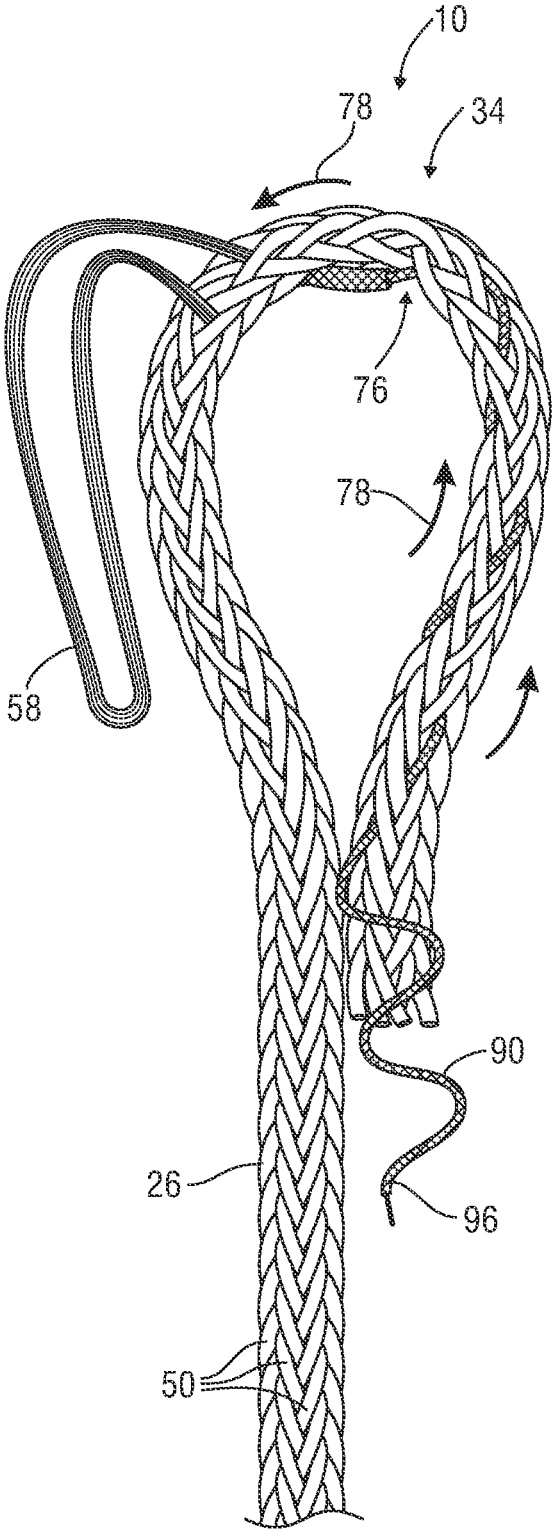
Figure 1G:
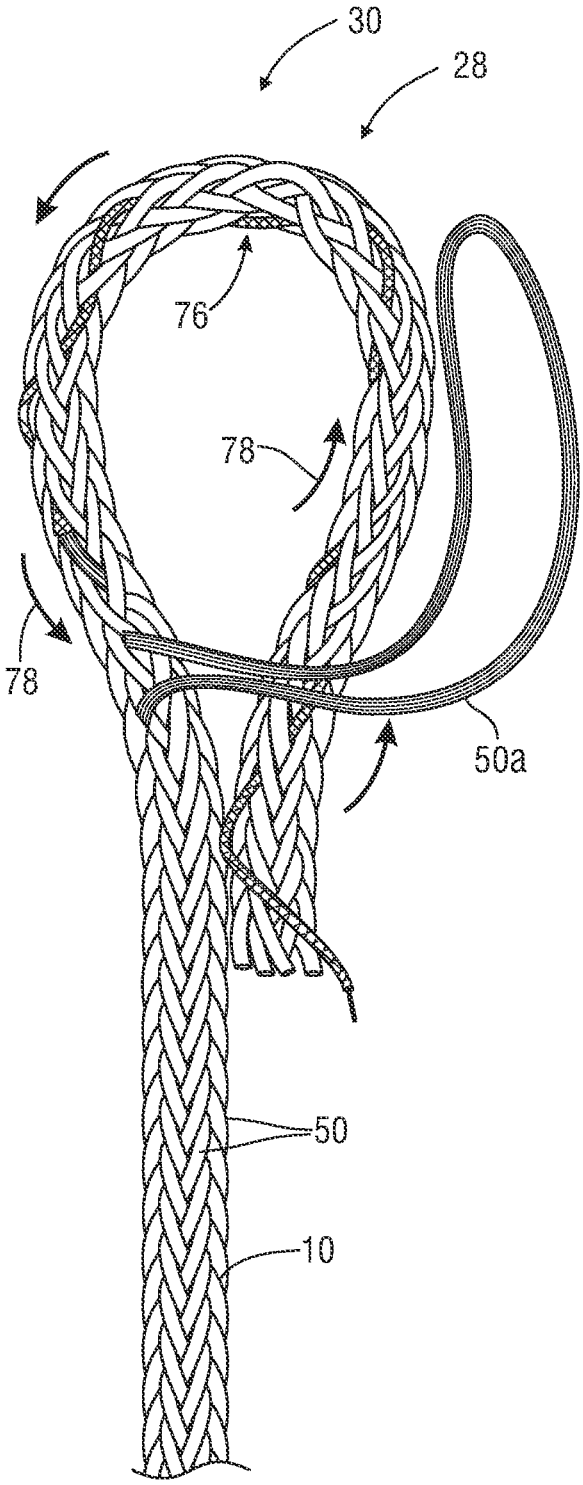
Figure 1H:
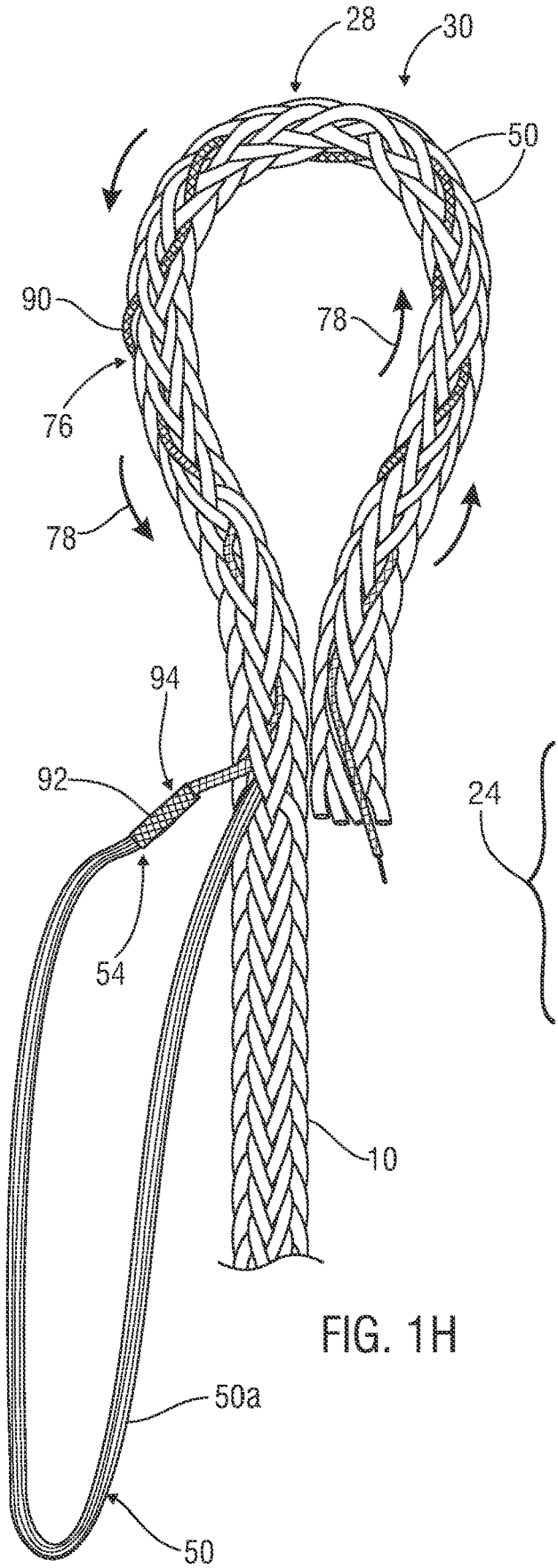
Figure 1I:
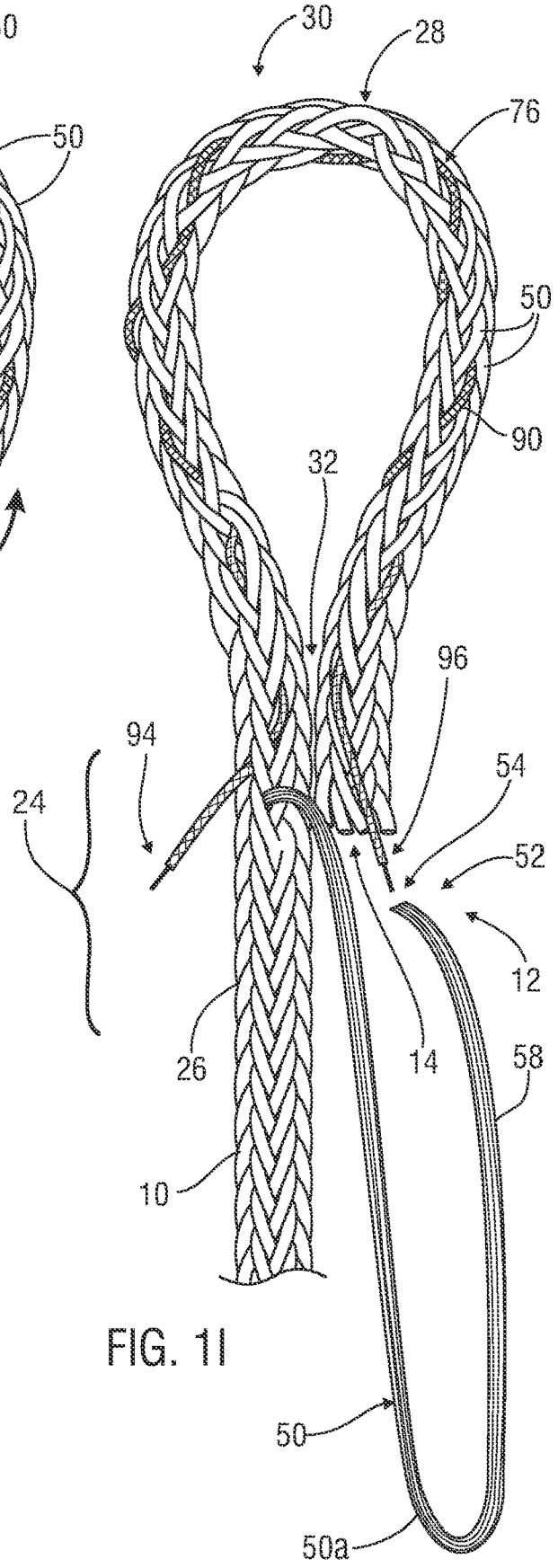

Referring to FIG. 1I, the exemplary strand 50*a* is shown separated from the rope 10 up to a point rearward of the intersection 32 (e.g. in the transition 24), the separated portion of the strand 50*a* being the reverse-direction strand section 58. However, in other embodiments, the strand 50*a* may be separated from the rope 10 only to a desired location in the eye portion 28 or even rearward of the transition 24. Likewise, different strands 50 may be separated from the rope 10 up to different locations in the rope 10.

Referring now to FIGS. 1I-1L, once the reverse-direction strand section 58 of the exemplary strand 50*a* is separated from the rope 10 as desired (e.g. from the eye portion 28 and part of the transition 24), the strand 50*a* may be returned back into the rope 10 at any desired location, for any desired distance or length and in any suitable manner. For example, the reverse-direction strand section 58 can be re-braided back into the part of the rope 10 it was removed from, but in the opposite direction. In this embodiment, the forward end 52 of the illustrated strand 50*a* is reintroduced into the rope 10 starting generally at the forward end 12 of the rope 10 (e.g. proximate to the forward tip 14 of the rope 10). Thus, the illustrated strand 50*a* will effectively cross over from the illustrated left side (e.g. transition 24) of the rope 10 to the illustrated right side (e.g. the forward end 12) of the rope 10 to help form the splice 40 and/or eye 30. The exact point of entry of the strand 50*a* back into the rope 10 (e.g. eye portion 28) is entirely discretionary.

Figure 1J:
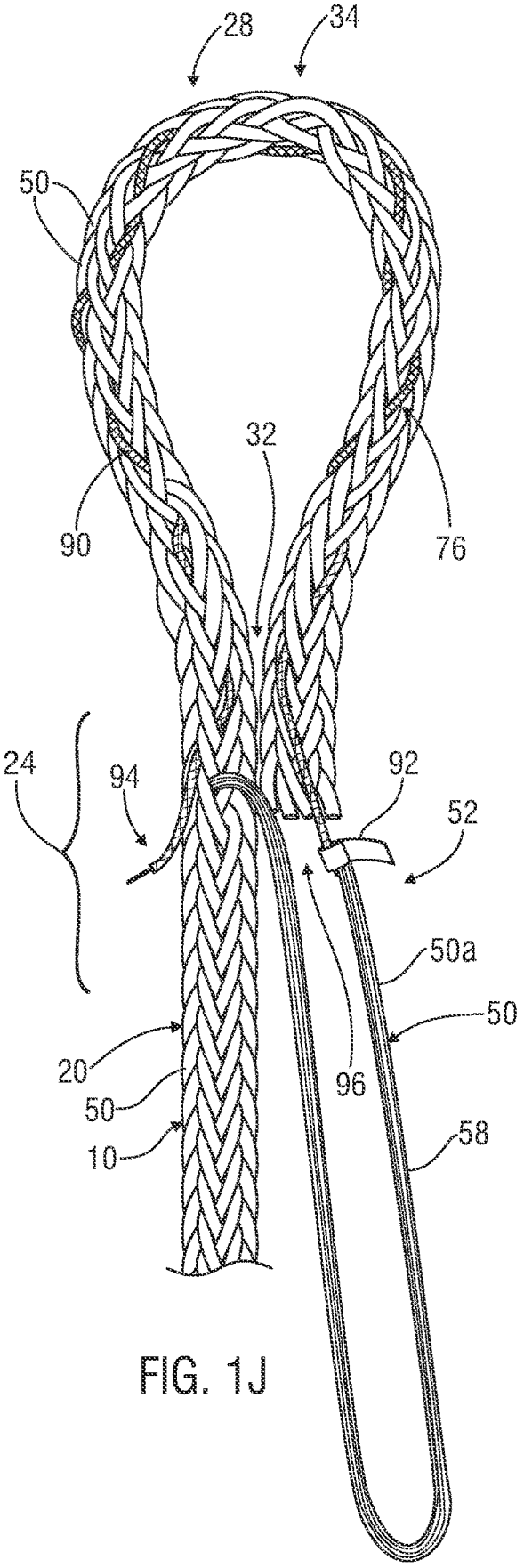
Figure 1K:
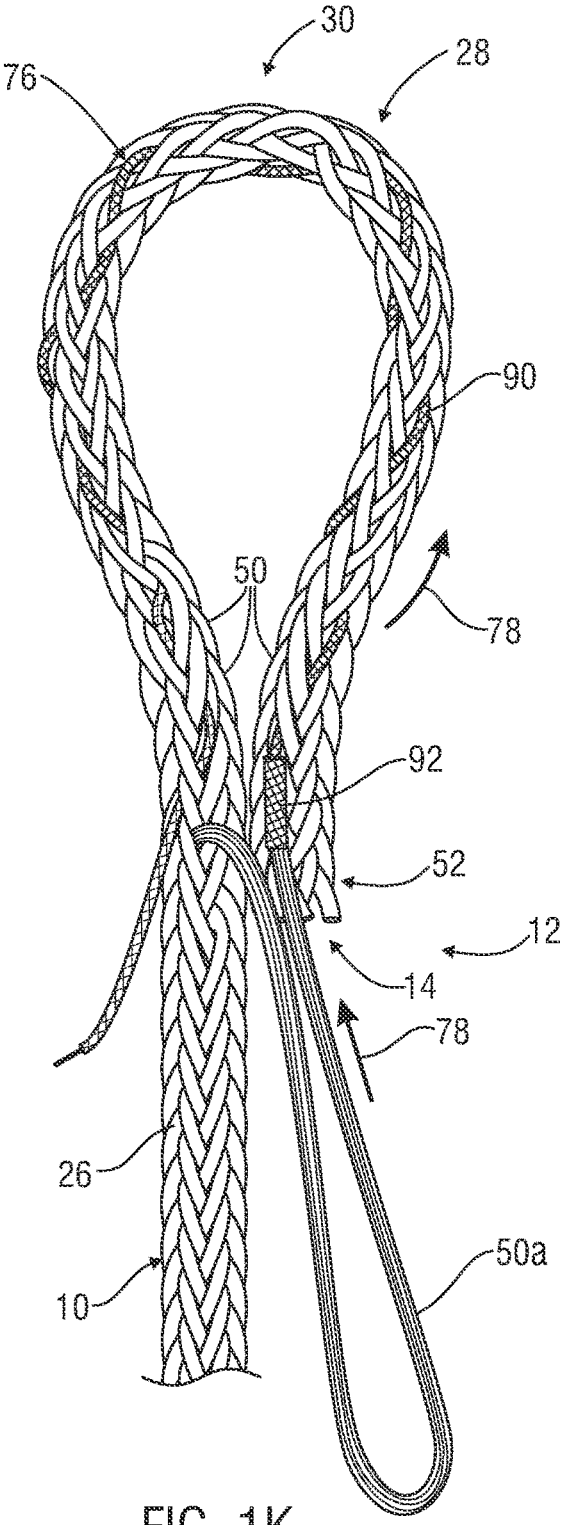
Figure 1L:
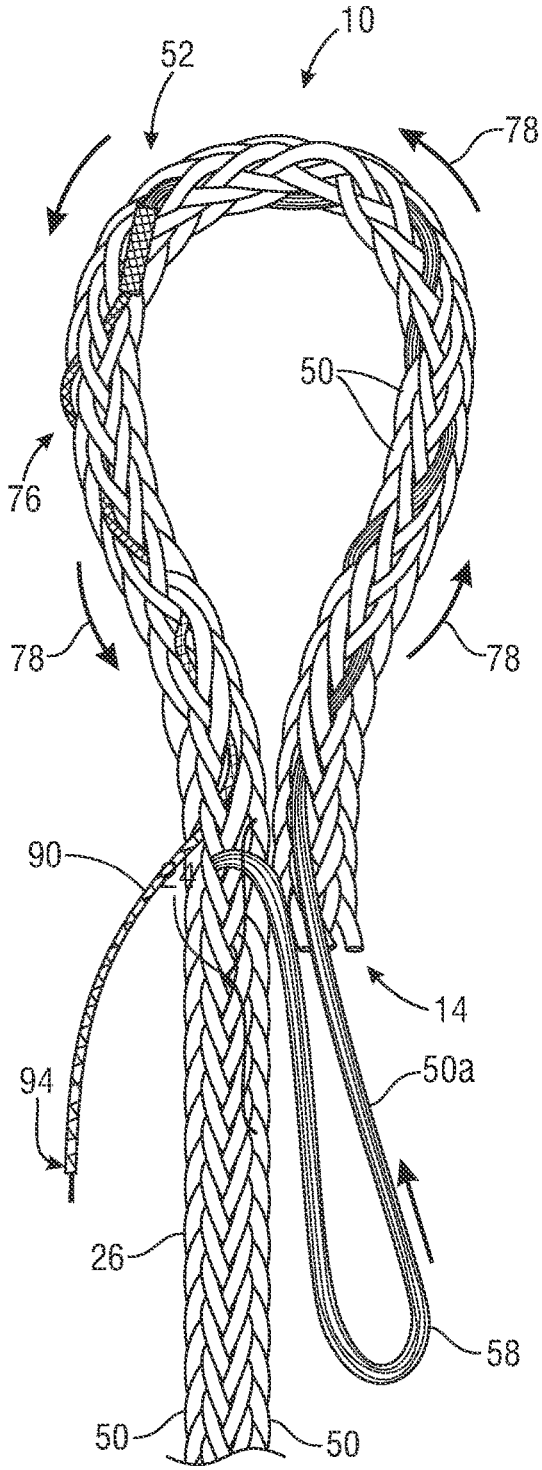
Figure 1M:
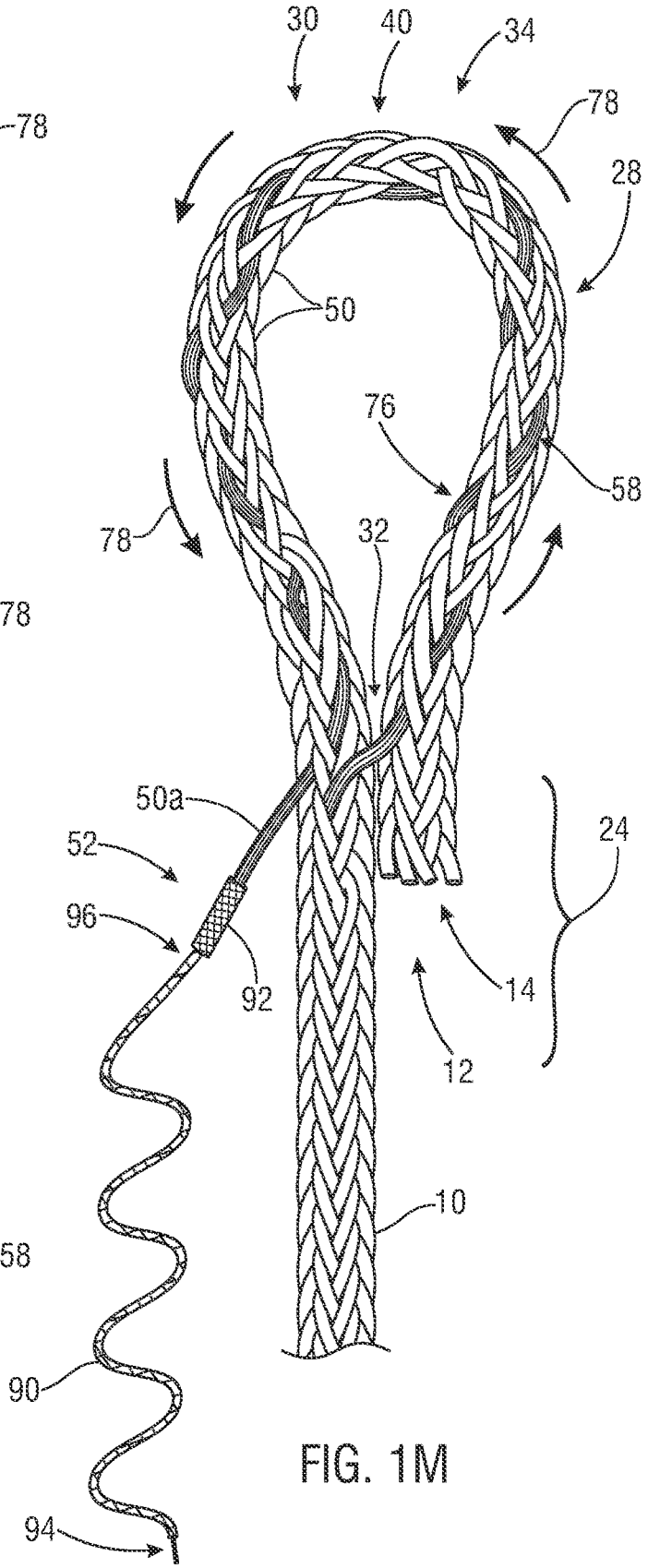
Figure 1N:
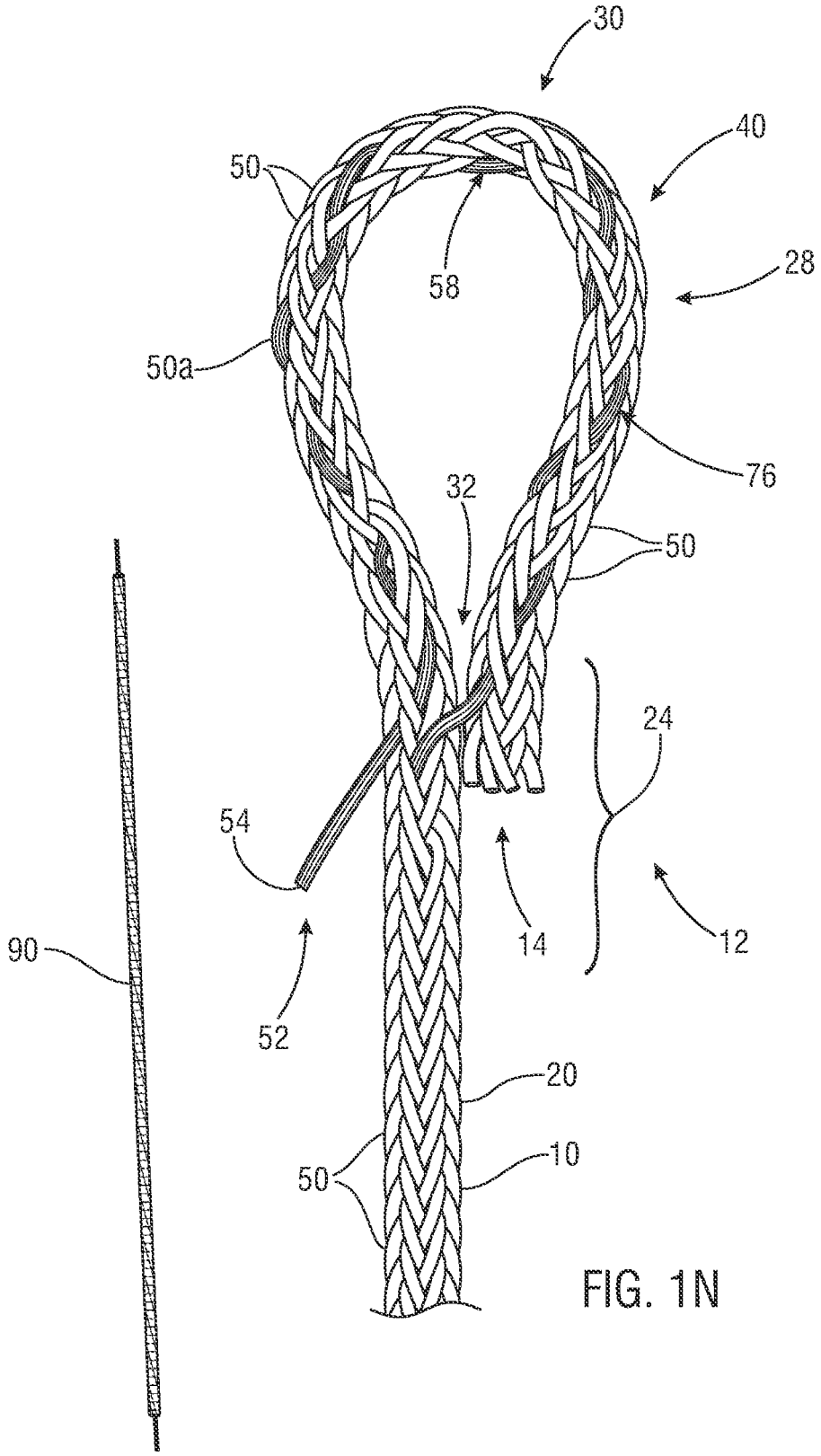

As shown in FIG. 1L-1M, the exemplary reverse-direction strand section 58 of the strand 50*a* is then returned (e.g. re-braided or rethreaded) into the rope 10 (e.g. through the entire length of the eye portion 28 of the rope 10 and ending generally in the transition 24). Thus, in this preferred embodiment, the reverse-direction strand section(s) 58 and the splice 40 effectively start and end in, or at, the transition 24 (rearward of the intersection 32). However, in other embodiments, the exemplary reverse-direction strand section(s) 58 may be removed from and/or returned into the rope 10 at one or more location in the eye portion 28 of the rope 10, forward of the intersection 32, rearward of the transition 24 or elsewhere as desired, and the splice 40 may effectively start and stop at any desired respective locations (e.g. start in the transition 24 and end in the eye portion 28 of the rope 10, start and stop in the eye portion 28, etc.).

Referring back to FIGS. 1C-1D, if it is desired to return at least part of the reverse-direction strand section 58 of the exemplary strand 50*a* into at least part of the same path, or void, 76 previously (e.g. originally) occupied by the strand 50*a* before it was separated from the rope 10, this may be done in any suitable manner. For example, the path 76 can be reserved, preserved or identified in any desired manner. In some embodiments, a guide, or stringer, 90 may be used. In the illustrated arrangement, the stringer 90 is coupled (e.g. temporarily) to the strand 50*a* so that it will occupy the path 76 (e.g. FIGS. 1E-1I) as the strand 50*a* is backed out of (or otherwise removed from) the rope 10.

When utilized, the stringer 90 may have any suitable form, configuration, construction and operation. The illustrated stringer 90 is a yarn, string or filament having the approximate length as the reverse-direction strand section 58 and with a suitable construction, structure, form and dimensions so that it will effectively be movable into, occupy, and be movable out of the path 76 as desired, but could take any other form. Thus, the inclusion, and any details, of the stringer 90 (when used) are not limiting upon the present disclosure.

In this embodiment, as shown in FIG. 1C, the forward tip 94 (or thereabouts) of the stringer 90 is releasably coupled (e.g. with tape 92) to the forward tip 54 (or thereabouts) of the strand 50*a*. As shown in FIGS. 1D-1I, as the exemplary strand 50*a* is separated from (e.g. backed out) the eye portion 28 of the rope 10 (and part of the transition 24), the illustrated stringer 90 will be drawn into and occupy its path 76.

Referring now to FIGS. 1H-1J, in this embodiment, after the stringer 90 occupies the desired part of the path 76, the strand 50*a* may be disconnected from the forward tip 94 (or thereabouts) of the stringer 90 and reconnected to its rear tip 96 (or thereabouts). For example, the forward tip 54 of the strand 50*a* may be disconnected from the forward tip 94 of the stringer 90 and then (e.g. temporarily) coupled to the rear tip 96 of the stringer 90 (e.g. with tape 92 or any other suitable manner).

Thereafter, as shown in FIGS. 1K-1M, the illustrated stringer 90 may be separated, pulled, or drawn out of the path 76 in the rope 10 (e.g. in the direction 78), similarly as described above for removal of the strand portion 58 (or in any other desired manner). The illustrated stringer 90 effectively pulls, drags or returns the strand 50*a* back into the path 76, but with the strand 50*a* now facing and travelling opposite its original direction. Once the exemplary strand 50*a* is returned into its path 76 as desired (e.g. through the eye portion 28 and into the transition 24), the stringer 90 may be disengaged therefrom. In this embodiment, after the exemplary strand 50*a* is returned in the rope 10 as desired, the forward end 52 thereof is shown extending out of the rope 10 generally in the transition 24 (e.g. FIGS. 1N-1O).

However, other techniques for returning at least part of a strand 50 into at least part of its previous path 76 in the rope 10 (or into a different path) may be used with or without a stringer 90, or with a stringer 90 but in a different manner. Moreover, some, all or none of the reverse-oriented strands 50 may be replaced into their previous respective paths 76 and through any desired part of the rope 10. For example, after a first strand 50 is separated from the rope 10, it could be (e.g. temporarily) coupled to a second strand 50 instead of a stringer 90. As the second strand 50 is separated from the rope 10 as desired, it could drag or pull the first strand 50 into (and to occupy) its path 76 (e.g. similarly as described above with respect to the use of a stringer 90). Thus, any desired number of strands 50 may be reverse-oriented in any desired paths through any portion(s) of the rope 10. In yet other embodiments, the strands 50 may not be returned into their prior or any particular paths 76.

Figure 1O:
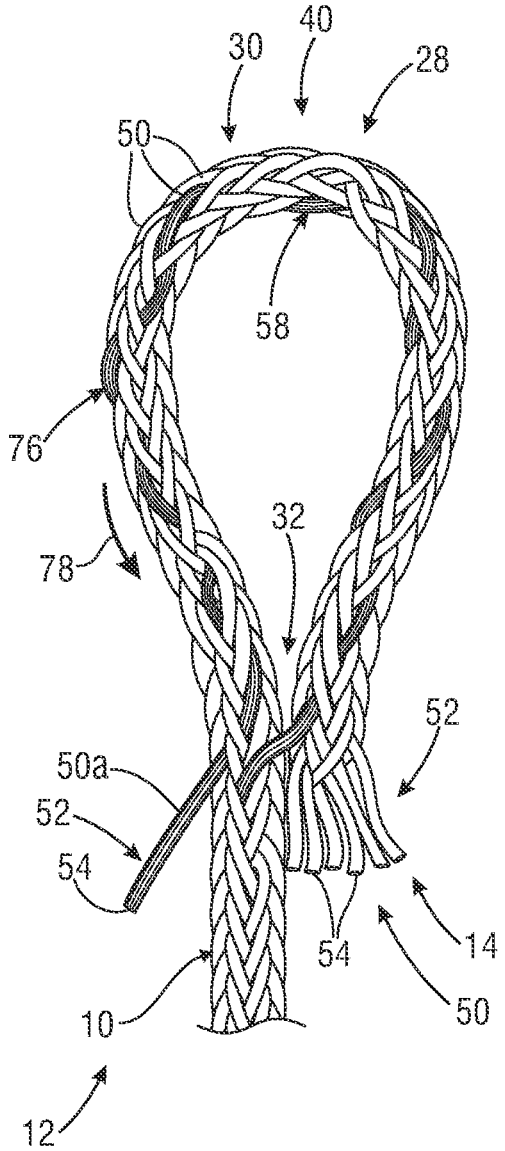
FIG. 1O is a top view of the exemplary rope of FIG. 1N showing the forward ends of the original-direction strands partially loosened in accordance with at least one embodiment of the present disclosure.
Figure 1P:
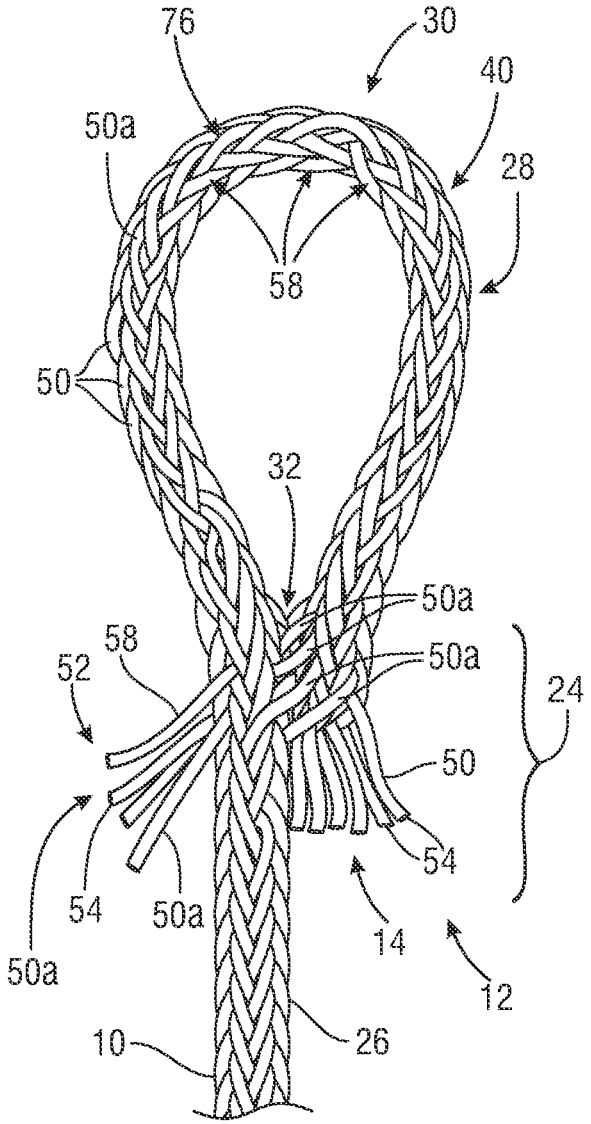
FIG. 1P is a top view of the exemplary rope of FIG. 1O showing a total of four exemplary reverse-direction strands extending through the eye portion of the rope and into the illustrated transition in accordance with at least one embodiment of the present disclosure.

Referring now to FIGS. 1O-1P, while there may be instances for reverse-orienting a reverse-direction strand section 58 of only one strand 50*a*, any desired parts of the exemplary processes described above with respect to strand 50*a* may be repeated for any desired quantity of strands 50*n*. FIG. 1P, for example, shows a total of four strands 50*a* that have been reverse-oriented at that particular moment in the process of forming the splice 40. In a preferred embodiment, half of the strands 50 of the rope 10 may be reverse-oriented (e.g. one at a time in the manner described above) through the entire eye portion 28 of the rope 10, the other half remaining essentially undisturbed in their original position and orientation. In such instance, if the exemplary reverse-oriented strands 50 are replaced into their previous respective paths 76, the original structure and strand configuration of the rope 10 may be maintained to help preserve and maximize rope efficiency and integrity, for any other purpose(s) or a combination thereof.

FIG. 4 shows the results of exemplary load tests on exemplary slings made with braided, synthetic, 12-strand rope 20 having eyes 30 at both ends, each formed with an exemplary splice 40 in accordance with one or more of the above embodiments of the present disclosure. However, the present disclosure is not limited to, or by, anything shown in, deduced or derived from FIG. 4.

Referring back to FIG. 1A, in accordance with these embodiments, if each reverse-direction strand section 58 separated is returned into the entire length of the eye portion 28 of the rope 10, the general thickness 42 of the rope 10 throughout the entire eye portion 28 should be substantially or entirely consistent, and also substantially or entirely equal to the original general thickness 44 of the rope 10 (e.g. the thickness 44 of the body 26 of the rope 10). Since the rope 10 normally has a generally cylindrical shape, the terms "thickness" and variations, as used herein, refers generally to the approximate width or diameter of the rope, or a portion thereof, at a particular location.

Still referring to FIG. 1A, in another independent aspect of the present disclosure, separate from reverse-orienting one or more strands 50 of the rope 10 (such as described above), one or more strands 50 of the rope 10 may, if desired, be coupled, or returned, to the rope 10 in and/or rearward of the eye 30. In some embodiments, the different strands 50, at or near their respective forward ends 52, may be coupled, or returned, to the rope 10 rearward of the intersection 32, such as to help form the transition 24 and tapered finish 80, for any other purpose(s) or a combination thereof.

For example, as shown in FIGS. 1O-1P, the forward end 52 of one or more of the exemplary (e.g. six) original-direction strands 50 may be loosened from the end 12 of the rope 10 (e.g. FIG. 1O) and returned (e.g. tucked) into the rope 10 generally at the transition 24. Likewise, the forward end of one or more of the exemplary (e.g. six) reverse-direction strands 50*a* may be returned (e.g. tucked) into rope 10 generally at the transition 24. In the present embodiment (FIG. 1A), all of the strands 50 of the rope 10, at or near their forward ends 54, are returned into the transition 24.

Referring back to FIG. 1A, if desired, the thickness of the rope 10 may be tapered down in any suitable manner, such as with a tapered finish 80. For example, different strands 50 of the rope 10 (e.g. at or proximate to their respective forward ends 52) may be returned into the rope 10 in different manners or configurations, locations in the rope 10, along different lengths of the rope 10 (e.g. at and/or rearward of the transition 24) or a combination thereof to assist in forming the taper or tapered finish 80. In some embodiments, different strands 50 may be tucked into the transition 24 different numbers of times or different distances to help form the desired (e.g. elongated, gradual) tapered finish 80. In the present embodiment, the forward end 52 of a first group 64 of tucked strands 50 extends generally rearward through transition 24 (e.g. via one or more tucks) for an approximate distance 86 and the forward end 52 of a second group 66 of tucked strands 50 extends rearward through transition 24 for a longer approximate distance 88 (e.g. via two or more tucks) to help create the tapered finish 80.

However, any part of any desired number of strands 50 may be tucked or otherwise returned into (or coupled to) the transition and/or other part of the rope 10 in any desired manner and for any desired distance to assist in forming a taper in any part of the rope 10 or a tapered finish 80 in the transition 24. For example, only some or none of the strands 50 may be tucked or otherwise returned into the rope 10. Thus, the present disclosure is not limited by the number of, which, or what part of, the strands 50 are returned into the rope 10 or at what location or for what distance, except and only to the extent as may be expressly specified otherwise herein or in a particular appended claim and only for such claim(s) and potentially those claim(s) depending therefrom.

Referring now to FIG. 3, an exemplary sling 16 having an eye 30 at each end formed with an exemplary splice 40 in accordance with the above described embodiments is shown. To give the reader an idea of the extraordinarily short length of a sling (and the rope 10 needed to form one or more exemplary eye splices) made in accordance with embodiments of the present disclosure (e.g. and meeting ASME B30.9 standards, current as of August 2021), in this particular example with the use of 3⅝", 12-strand, single-braid synthetic rope, where each illustrated eye 30 has an approximate length of 4' 8" when tensioned around a 6" pin, the length of each illustrated transition 24 with tapered finish 80 (extending from a point rearward of the corresponding intersection 32 (where the tapered finish starts) to the corresponding forward edge of the body 26) is only approximately 16" long, which is equal to or under approximately four times the thickness 44 of the rope 10. The body 26 of this exemplary sling 16 (extending between the rearward edge of each transition 24) has a length 98 of only approximately 3' 11½" and the total sling length is approximately 16', or approximately half the length of a typical similar-capacity sling made using presently known traditional rope eye splicing technology meeting ASME B30.9 standards. However, the present disclosure is not limited to the above exemplary dimensions or other details, except and only to the extent as may be expressly specified otherwise herein or in a particular appended claim and only for such claim(s) and potentially those claim(s) depending therefrom.

It should be noted that the particular sequence of performing the exemplary processes above may be changed. Likewise, additional or fewer actions may be performed for forming the exemplary splice 40. For example, two strands 50 may be separated before either are returned into the rope 10. For another example, the forward ends 52 of the original-direction strands 50 may be coupled to the transition 24 at any stage in the process. Thus, the present disclosure is not limited to or by the aforementioned technique.

Figure 2A:
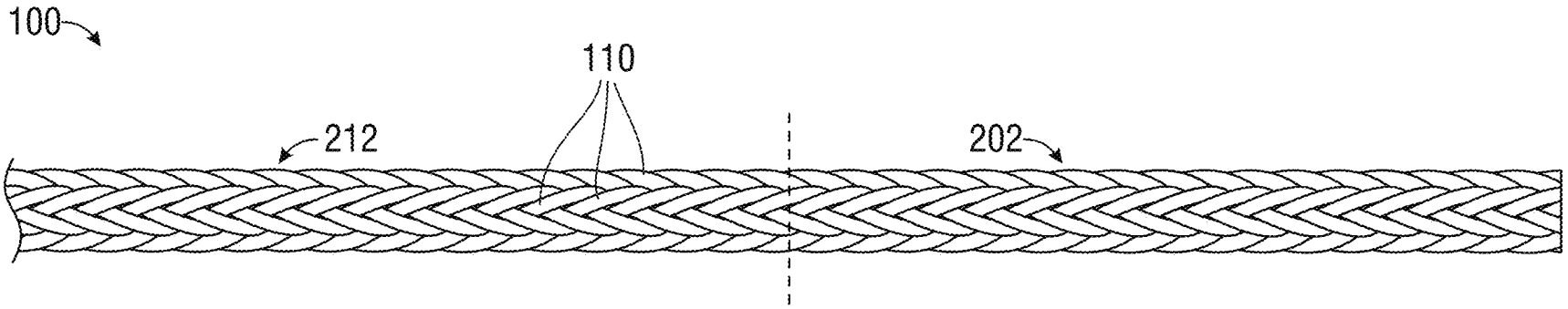
FIG. 2A is a top view of an exemplary rope that may be used for forming an exemplary eye with a spliced-connection in accordance with at least one embodiment of the present disclosure.

Now referring to FIGS. 2A-2T, various embodiments of the present disclosure involve a sling or other eyed-rope component (not shown) made from a single length of rope 100 comprised of strands 110 (e.g. alternating between primary-oriented strands 220 oriented or angled to the left and alternative-oriented strands 230 oriented or angled to the right) initially woven together facing one direction. The primary-oriented strand distal ends 222 and the alternative-oriented strand distal ends 232 are both located initially in the distal end 206 of the rope 100. These embodiments involve at least one of the primary-oriented strands 220 and at least one of the alternative-oriented strands 230 becoming woven back into the rope 100 such that one or more strands 110 now transition from a first direction to a second direction as the rope 100 becomes the resulting sling with an eye 104. The exemplary primary-oriented strands 220 and alternative-oriented strands 230 that weave in a second direction couple back to the main rope 100 at the throat 106.

Figure 2B:
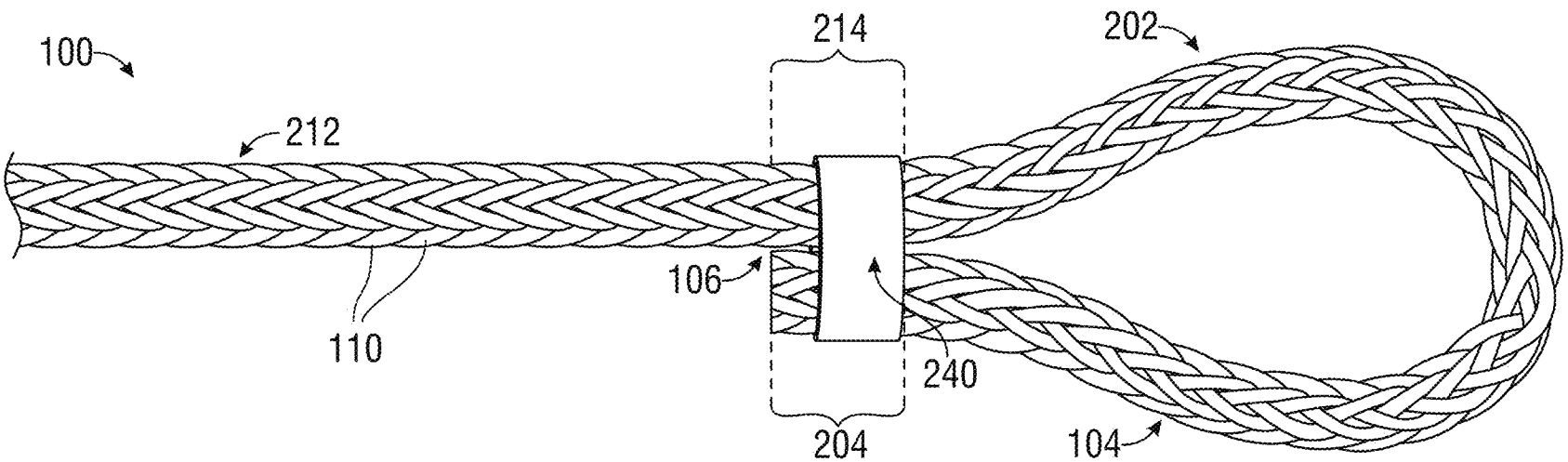
FIG. 2B is a top view showing the exemplary rope of FIG. 2A oriented to form an exemplary eye in accordance with at least one embodiment of the present disclosure.

These exemplary embodiments utilize a method of braiding rope to create the eye 104 with a splice, while minimizing the amount of rope 100 used. As shown in FIG. 2A, the distal section 202 of the illustrated rope 100 is the part where the eye 104 will form, as opposed to the central section 212 which makes up the remainder of the rope 100. FIG. 2B shows the area where the exemplary rope 100 comes back on itself, called the throat 106, and includes two sections: the distal throat section 204 and the central throat section 214. The distal throat section 204 is the section of the rope 100 between the eye 104 and the distal end 206 of the rope 100. The central throat section 214 is the section of the rope 100 between the eye 104 up to a line defined by the distal end 206 of the rope 100.

To make the eyed-rope (e.g. sling) of these embodiments, the first step is to calculate how large to make the eye 104. For example, the amount of rope 100 needed to form the eye 104 may be based on the diameter of the rope 100 used to maintain strength. In an exemplary embodiment, the length of rope 100 needed to form the eye 104 may be twenty four times the diameter of the rope 100 used. This factor may change based on peculiarities of the rope 100 and other factors. Once the size of the exemplary eye 104 is determined, the amount of rope 100 needed for the eye 104 is calculated. For example, the amount of rope 100 needed is equal to the amount of rope 100 used for the eye 104 plus an additional 25% of that same length to secure it to the central throat section 214.

In these embodiments, the distal end 206 of the rope 100 is manipulated in a manner where the individual primary-oriented strands 220 and alternative-oriented strands 230 become loose and may be separated at the distal end 206 of a rope 100. The exemplary eye 104 is formed when at least one of the primary-oriented strands 220 and at least one of the alternative-oriented strands 230 are woven in a manner causing an eye 104 to form where at least one primary-oriented strand 220 and at least on alternative-oriented strand 230 is woven in an opposite direction from the original orientation of the strand 110. The result may be an exemplary eye 104 where up to half of the strands 110 are woven in a parallel but opposed manner to result in an eye 104.

Figure 2C:
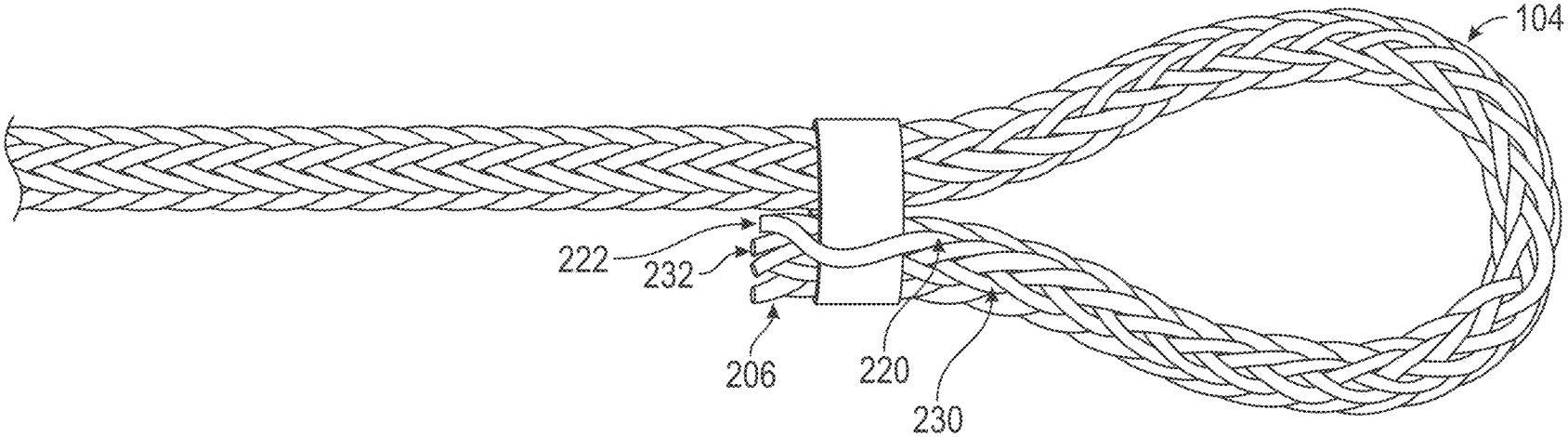
FIG. 2C is a top view showing the exemplary rope of FIG. 2B where a distal end of a primary-oriented strand is loosened in accordance with at least one embodiment of the present disclosure.
Figure 2D:
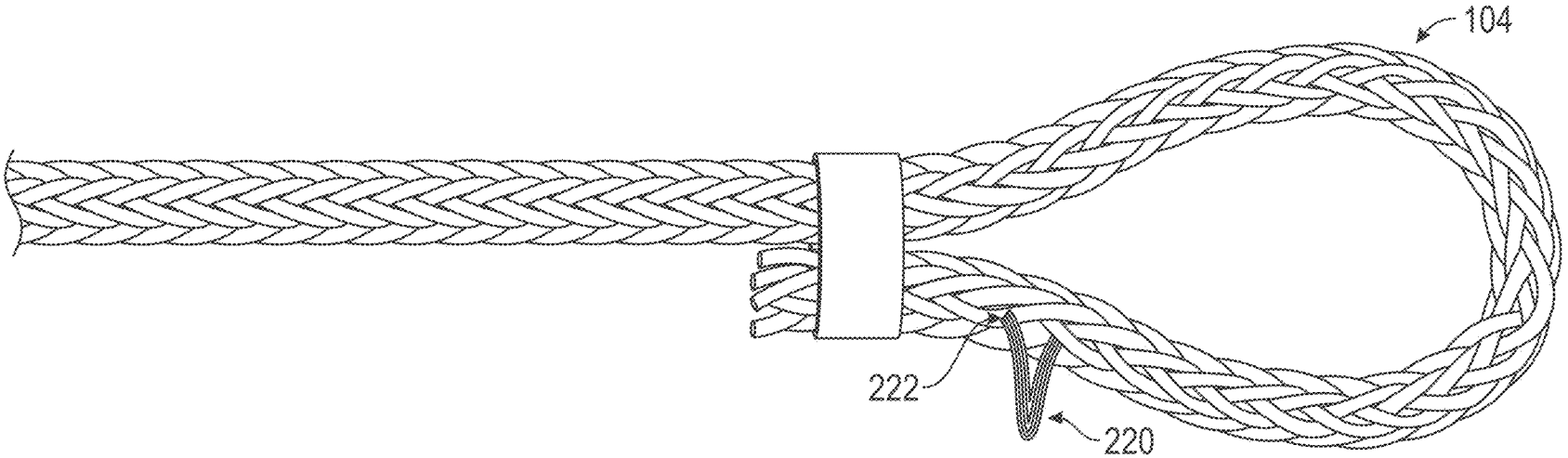
FIG. 2D-I are top views of the exemplary rope of FIG. 2C showing separation of an exemplary primary-oriented strand through the eye of the rope until it is loose in the central throat area in accordance with at least one embodiment of the present disclosure.
Figure 2E:
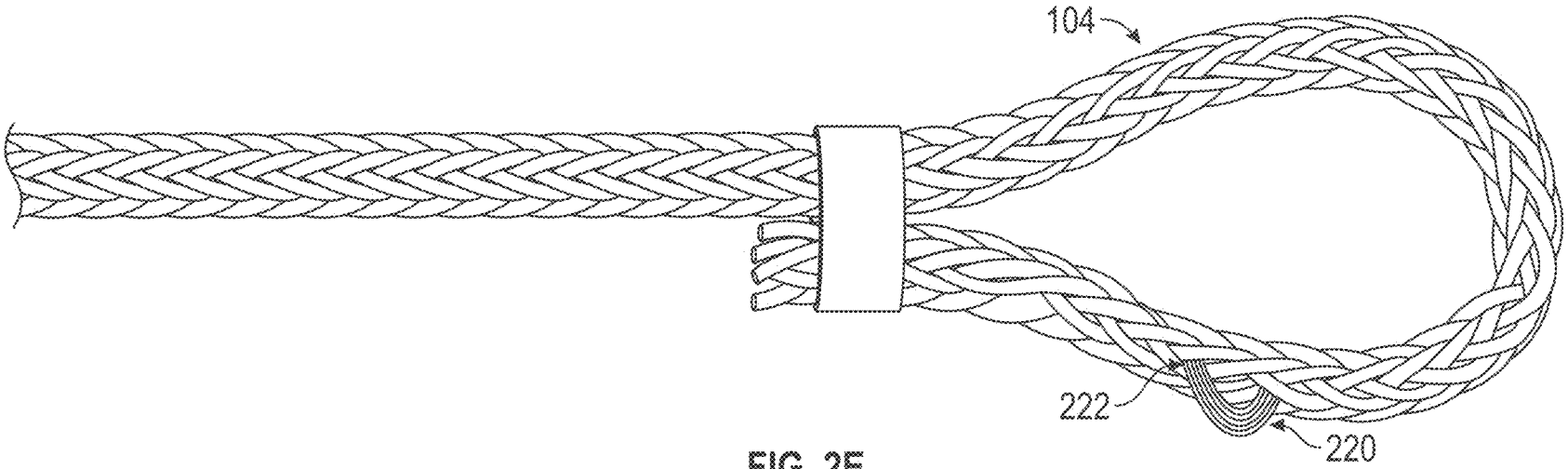
Figure 2F:
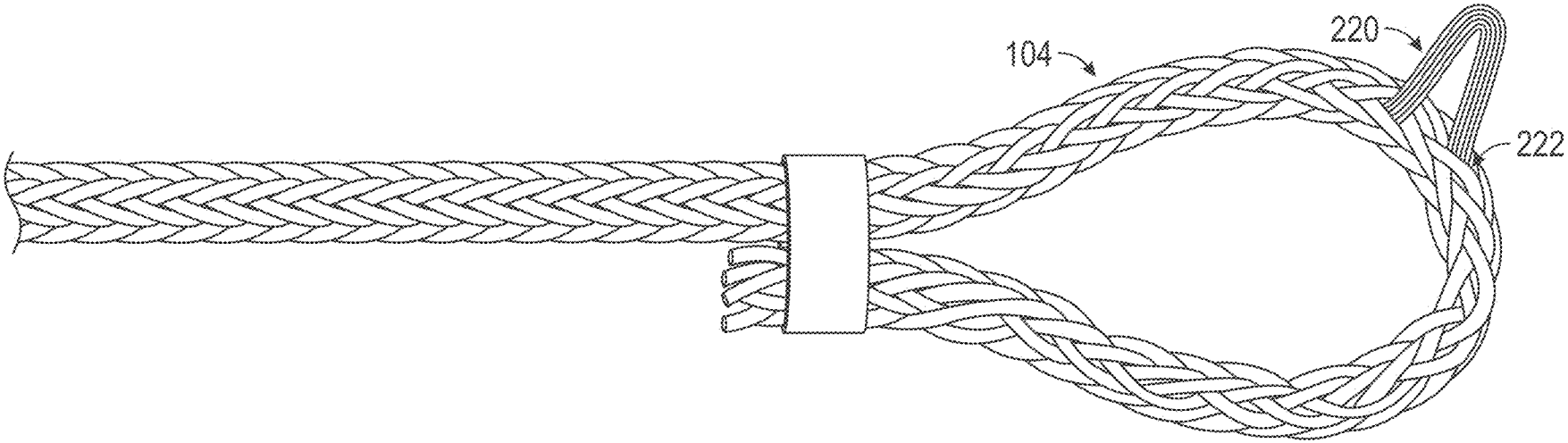
Figure 2G:
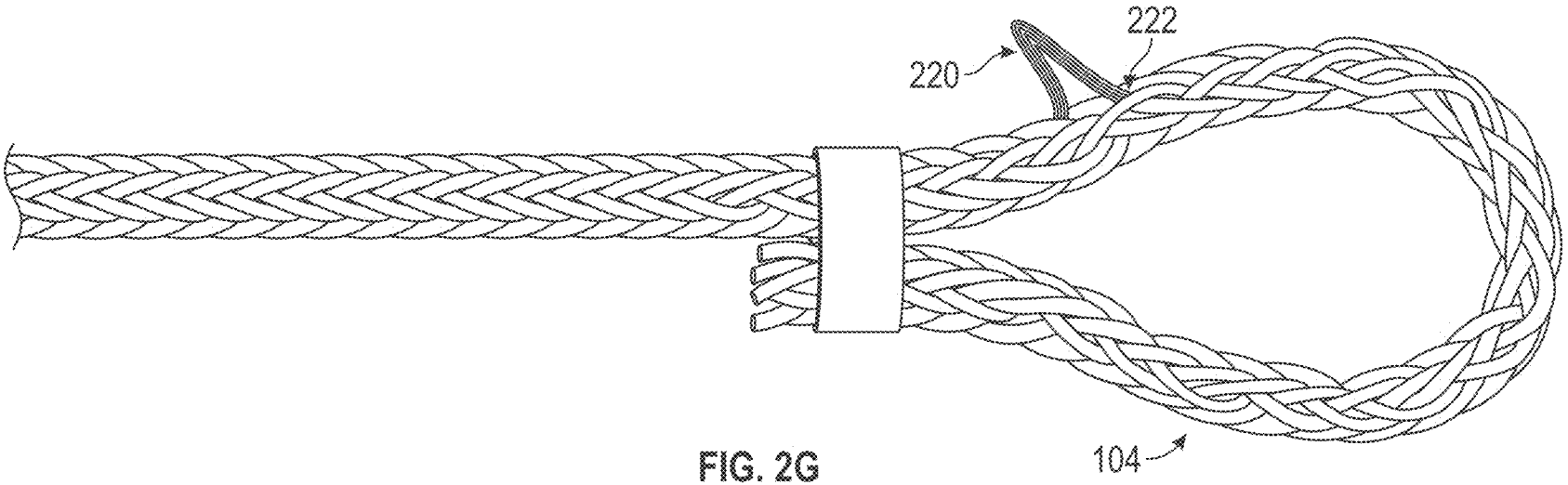
Figure 2H:
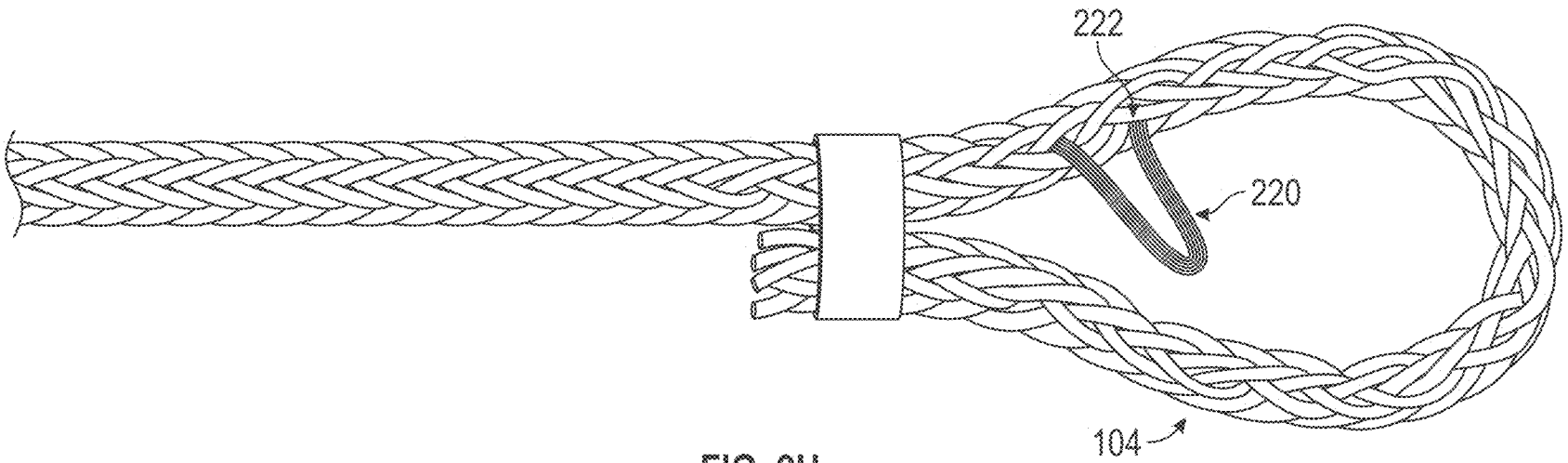
Figure 2I:
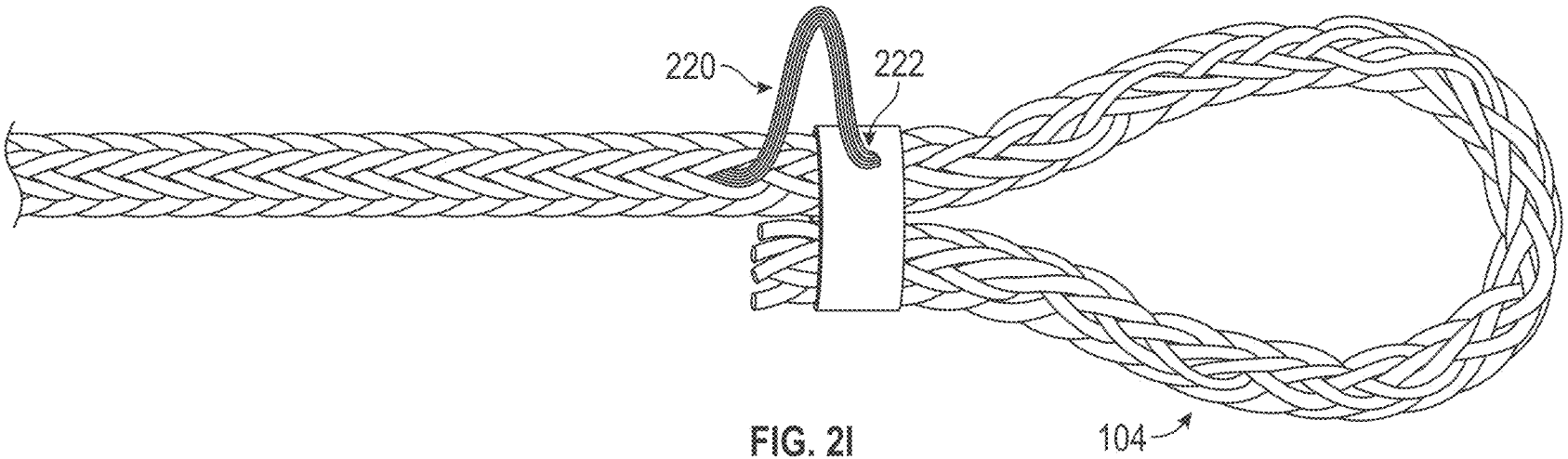
Figure 2J:
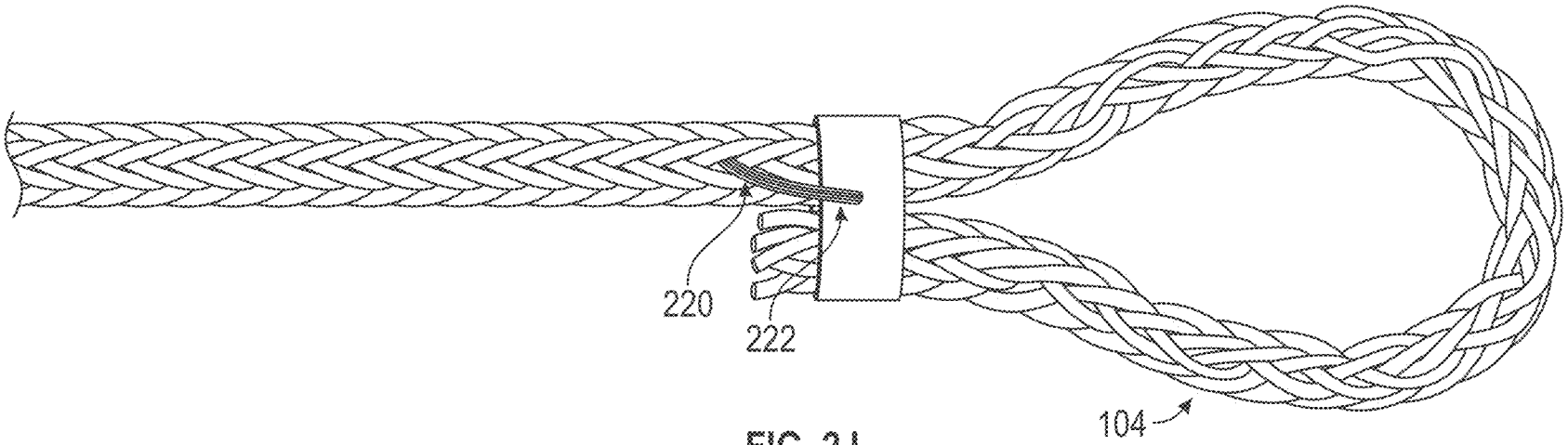
FIG. 2J is a top view of the exemplary rope of FIG. 2I showing the distal end of the exemplary primary-oriented strand completely withdrawn from the eye in accordance with at least one embodiment of the present disclosure.
Figure 2K:
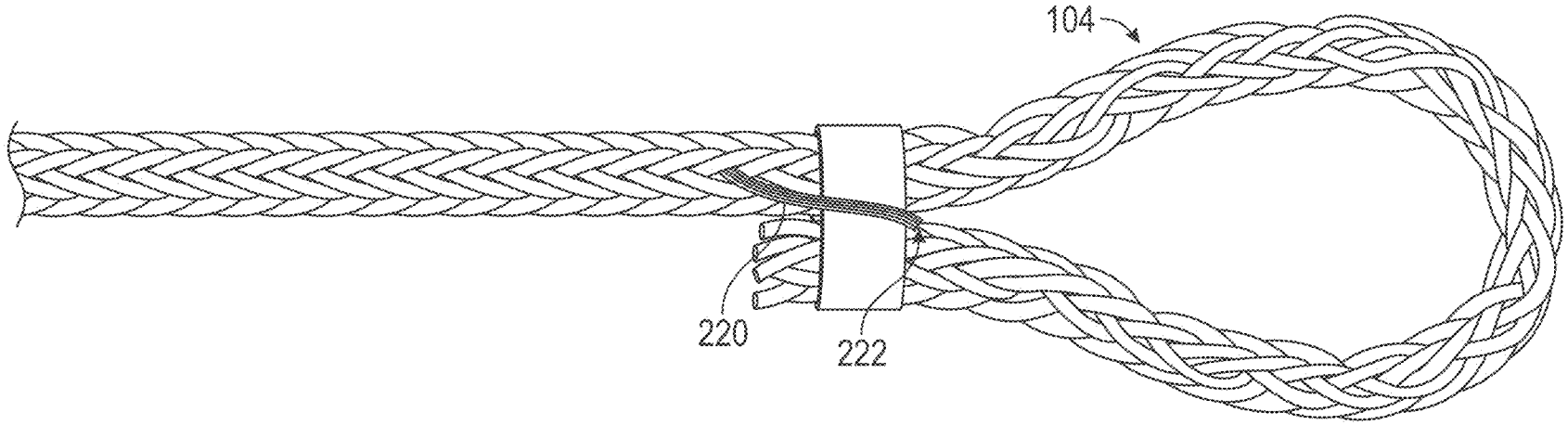
FIG. 2K-P are top views of the exemplary rope of FIG. 2J showing the exemplary primary-oriented strand threaded back through the eye starting at the distal throat section in accordance with at least one embodiment of the present disclosure.
Figure 2L:
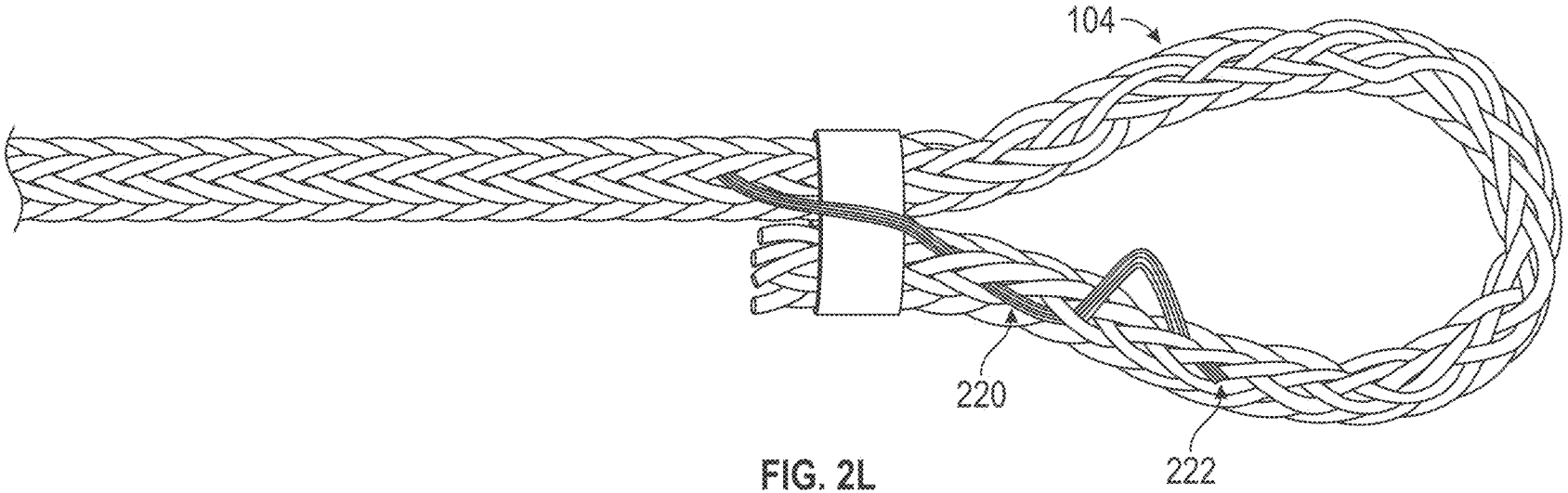
Figure 2M:
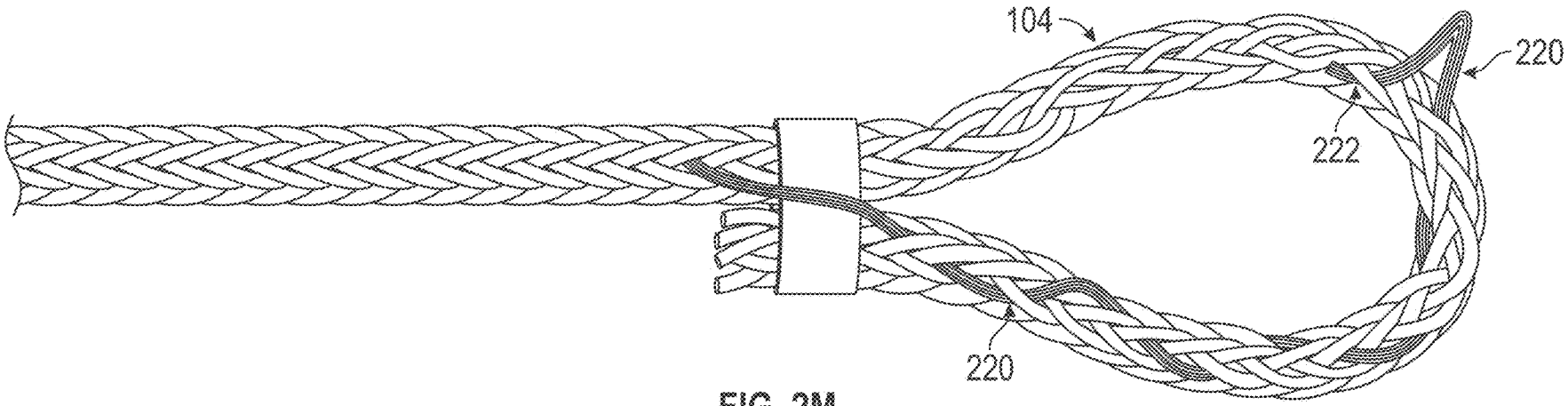
Figure 2N:
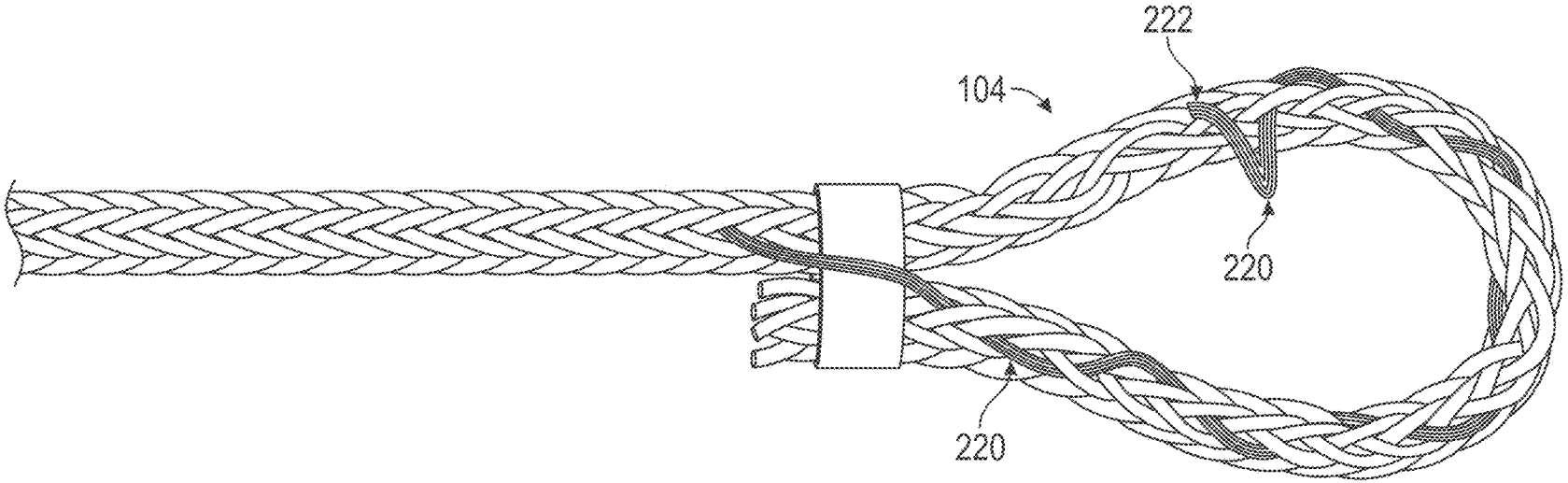
Figure 2O:
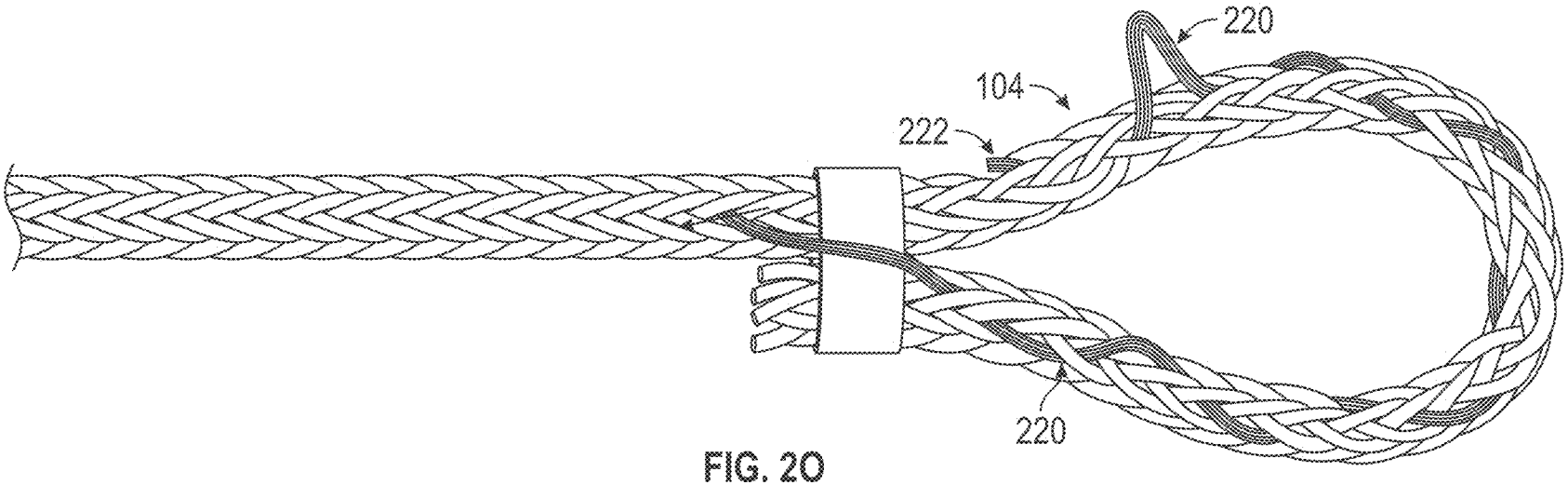
Figure 2P:
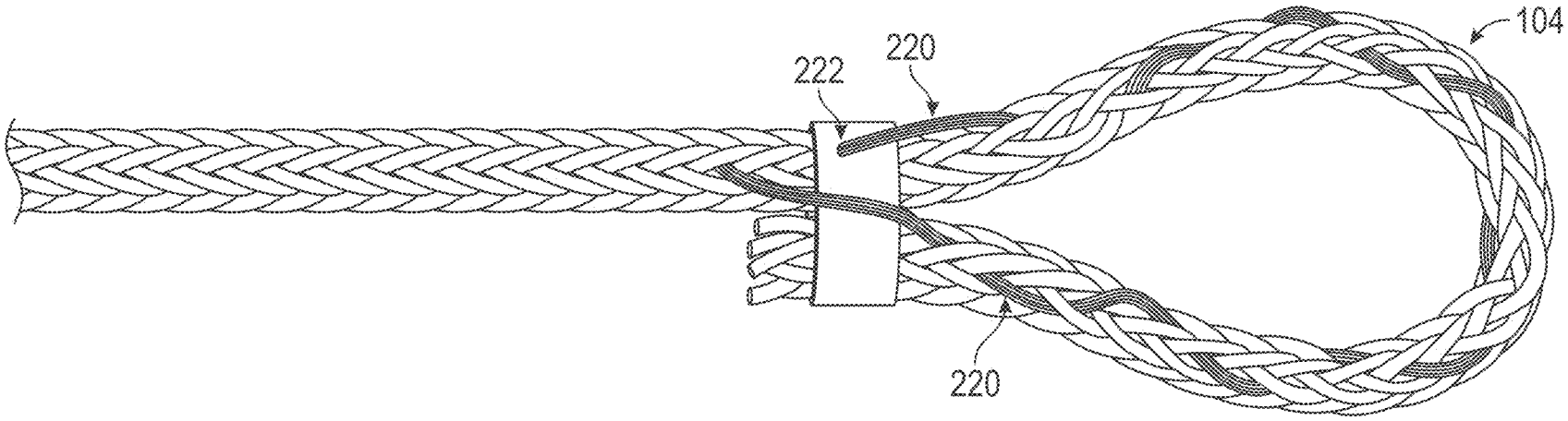
Figure 2Q:
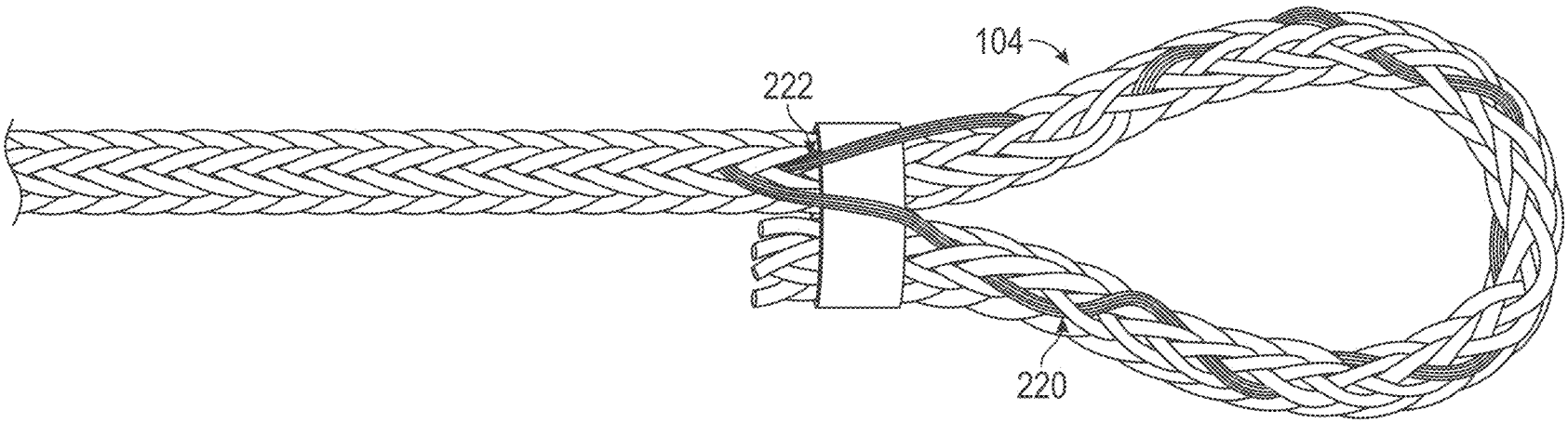
FIG. 2Q is a top view of the exemplary rope of FIG. 2P showing the primary-oriented strand may now be tucked back in the rope in accordance with at least one embodiment of the present disclosure.

A simplification of an exemplary process of creating the exemplary eye is shown in FIG. 2A-Q. For purposes of illustration only, the rope 100 consists of primary-oriented strands 220 and alternative-oriented strands 230. A binder 240 may be used to initially hold the distal end 206 of the rope 100 in place, but may not be needed.

At the distal end 206 of the illustrated rope 100, a primary-oriented strand 220 is loosened as shown in FIG. 2C. The primary-oriented strand 220 is then extracted through the illustrated rope 100 up to the central throat section 214 as shown in FIGS. 2D-2I. The withdrawal of the primary-oriented strand 220 may create a void in the rope 100. The exemplary primary-oriented strand distal end 222 then enters the throat 106 in the distal throat section 204 and, if desired, goes back through the void created by the earlier withdrawal of primary-oriented strand 220. The illustrated primary-oriented strand 220 is now occupying substantially the same position as before, but oriented in the opposite direction. After that primary-oriented strand 220 is threaded back through the eye 104, if desired, it may then be tucked back into the central throat section 214 (e.g. as shown in FIG. 2Q).

While FIG. 2K shows the insertion of the exemplary primary-oriented strand distal end 222 into the distal throat section 204 up from the binder 240, it is understood that the primary-oriented strand distal end 222 may be inserted into the distal end 206 of the rope 100 and accomplish the same objective.

After the withdrawal of an exemplary primary-oriented strand 220, an alternative-oriented strand 230 may now be removed. The procedure may be substantially similar to the procedure previously shown in FIG. 2A-Q. For example, at the distal end 206 of the rope 100, an alternative-oriented strand 230 may be loosened. The alternative-oriented strand 230 may then be extracted through the rope 100 up to the central throat section 214. The withdrawal of the alternative-oriented strand 230 may create a void in the rope 100. In this embodiment, the alternative-oriented strand distal end 232 then enters the throat 106 in the void created by the earlier withdrawal of alternative-oriented strand 230, but oriented in the opposite direction. The alternative-oriented strand 230 may be threated threaded back through the eye 104 and then tucked back into the central throat section 214.

If desired, the process of withdrawing and rethreading primary-oriented strands 220 and alternative-oriented strands 230 is repeated. This may be repeated any number of times depending on the embodiment. In an exemplary embodiment, this is repeated until half of the primary-oriented strands 220 and alternative-oriented strands 230 have been modified.

In some embodiments, there are twelve strands 110 with six primary-oriented strands 220 and six alternative-oriented strands 230. FIG. 5 shows how the process may proceed in certain embodiments with strands 110 in both primary and alternative orientations. In FIG. 5, primary-oriented strands 220 are grouped in sets of two and are staggered with alternative-oriented strands 230 in sets of two. The redirection of strands may be repeated until one strand of each set of two strands 110 are opposite of their original counterpart. However, the present disclosure is in no way limited to or by anything shown in, suggested by or deduced from FIG. 5.

If desired, the primary-oriented strands 220 and alternative-oriented strands 230 may be coupled to the rope 100. For example, the strands 110 may be tucked back into the rope 100. Alternatively, they may be secured back to the rope 100 by binding to the primary-oriented strand distal ends 222 with the alternative-oriented strand distal ends 232. The process may be repeated with additional primary-oriented strands 220 and alternative-oriented strands 230.

In these embodiments, it may be preferred that when a strand 110 is guided back into the rope 100, it should fill the original location of the strand 110. However, when a strand 110 is withdrawn, it might be orientated in a manner that it cannot easily be reintroduced to its original location. A typical situation involves the strand 110 being blocked by the body of the rope 100 itself. In that situation, a fid may be used to guide the distal end of the strand 110 through the body of the rope 100 to become adjacent to the point where it was reintroduced into the rope 100.

When the exemplary primary-oriented strands 220 and alternative-oriented strands 230 are threaded back through the rope 100 in their original locations, a guide may be used. For example the guide may be a filament that is as long as the length of rope 100 used to form the eye 104. The dimensions of the guide may allow the guide to occupy the void left by the withdrawal of a corresponding strand 110. In some instances, due to the elasticity of the rope 100, the guide may be larger than the dimensions of the strand 110 removed. The exemplary guide has a first guide end and a second guide end. In an exemplary embodiment using a guide, the primary-oriented strands 220 and alternative-oriented strands 230 are removed tuck by tuck. The exemplary guide is left behind in the rope 100 after the initial removal to assist in rethreading the primary-oriented strand 220 and alternative-oriented strands 230 back through the eye 104.

In an exemplary embodiment using a guide, the primary-oriented strand 220 is loosened at the distal end 206. Before the primary-oriented strand 220 is removed, the primary-oriented strand distal end 222 is coupled to a first guide end. As the exemplary primary-oriented strand 220 is withdrawn as shown in FIG. 2A-Q, the guide is left in the space created by the withdrawn primary-oriented strand 220 and remains intertwined with the remaining rope 100. Once the primary-oriented strand 220 is removed up to the central throat section 214, the first guide end may be decoupled from the primary-oriented strand distal end 222.

The exemplary guide remains in the eye 104, with its first guide end exiting at the central throat section 214 and the second guide end exiting at the distal throat section 204. The second guide end 258 may then be coupled to the primary-oriented strand distal end 222 and the guide withdrawn from the rope 100 from the first guide end through the central throat section 214. As the guide is withdrawn, the exemplary primary-oriented strand 220 is rethreaded through the eye 104 and occupies the void left with the primary-oriented strand 220 was initially withdrawn. If desire, the primary-oriented strand 220 may then be coupled back to the central throat section 214, such as previously discussed. This exemplary process may be similarly performed with the alternative-oriented strand 230.

Preferred embodiments of the present disclosure thus offer advantages over the prior art and are well adapted to carry out one or more of the objects of this disclosure. However, the present invention does not require each of the components and acts described above and is in no way limited to the above-described embodiments or methods of operation. Any one or more of the above components, features and processes may be employed in any suitable configuration without inclusion of other such components, features and processes. Accordingly, different embodiments of the present disclosure may have any one or more of the features described or shown in, or which may be apparent from, this patent. Moreover, the present invention includes additional features, capabilities, functions, methods, uses and applications that have not been specifically addressed herein but are, or will become, apparent from the description herein, the appended drawings and/or claims.

The methods described above or claimed herein and any other methods which may fall within the scope of the appended claims can be performed in any desired or suitable order and are not necessarily limited to any sequence described herein or as may be listed in the appended claims. Further, the methods of various embodiments of the present disclosure may include additional acts beyond those mentioned herein and do not necessarily require use of the particular components shown and described herein, but are equally applicable with any other suitable structure, form and configuration of components.

While exemplary embodiments have been shown and described, many variations, modifications and/or changes of the system, apparatus and methods of the present disclosure, such as in the components, details of construction and operation, arrangement of parts and/or methods of use, are possible, contemplated by the patent applicant(s) hereof, within the scope of any appended claims, and may be made and used by one of ordinary skill in the art without departing from the spirit, teachings and scope of this disclosure and any appended claims. Thus, all matter herein set forth or shown in the accompanying drawings should be interpreted as illustrative, and the scope of the disclosure and any appended claims should not be limited to the embodiments described or shown herein.

The invention claimed is:

1. A rope structure comprising:

a multi-strand, single-braid rope having a diameter and forward and rear ends, the rope being formed with at least four strands braided together in an original direction toward the forward end of the rope with each strand occupying a unique original tortuous path in the rope and having respective forward and rear ends at the respective forward and rear ends of the rope, the rope including:

a braided eye having a length and being formed of a desired portion of the rope at the forward end of the rope, the braided eye having a braided splice extending through the entirety of the length of the braided eye, the braided splice including a first plurality of reverse-oriented strands extending rearward through the entire eye, each such strand disposed in a distinct tortuous path in the direction of the rear end of the rope, and a second plurality of strands extending through the entire eye, each such strand disposed in its respective original tortuous path in the direction of the forward end of the rope, wherein all strands of the rope are braided together through the entire eye, a braided transition disposed between the body and eye and having a tapered finish, wherein the forward end of two or more of the strands is tucked into the transition in the direction of the rear end of the rope, at least a first strand being tucked into the transition at least once so that it extends into the transition a first distance and at least a second strand being tucked into the transition more times than the first strand so that it extends in the transition a second distance, whereby the second distance is greater than the first distance;

wherein a first half of the first plurality of strands comprises primary-oriented strands and a second half of the first plurality of strands comprises alternative-oriented strands, a first half of the second plurality of strands comprises primary-oriented strands and a second half of the second plurality of strands comprises alternative-oriented strands, and one or more of the reverse-oriented strands stop in the braided eye forward of an intersection of the rope where two sides of the eye meet.

2. The rope structure of claim 1 wherein each of the first plurality of strands, having been independently removed from the forward end of the rope through the entire portion of the rope used to form the eye and, starting at the forward end of the rope, returned back into the entire portion of the rope used to form the eye in each respective distinct tortuous path in the direction of the rear end of the rope without any other strands, at the same time, being unbraided or removed from the entire portion of the rope used to form the eye, is oriented to help preserve the braided configuration, integrity and original strength of the rope forming.

3. The rope structure of claim 1 wherein each of the first plurality of strands occupies at least substantially the same tortuous path it previously occupied through the entire eye but in the direction of the rear end of the rope.

4. The rope structure of claim 1 wherein the transition is formed with a length equal to or less than six times the diameter of the rope.

5. The rope structure of claim 1 wherein the body of the rope extends from the transition to the rear end of the rope, further wherein the body has a length that is smaller than the length of the eye and the rope meets ASME B30.9 sling standards.

6. The rope structure of claim 1 wherein the forward end of none of the strands is tucked or returned into the body of the rope.

7. The rope structure of claim 6 wherein the transition has a length that is under 35% the length of the body of the rope.

8. The rope structure of claim 1 wherein the rope, being single-braided, is unjacketed.

9. The rope structure of claim 1 wherein the eye and transition are uncovered.

10. The rope structure of claim 1 wherein the eye and transition are configured to maintain the original strength of the rope without the use of a jacket and without covering either the eye or the transition, the rope having sufficient strength to be used in mooring, towing and anchoring ships and floating platforms and as a sling or winch line in heavy construction.

11. A method of forming the braided eye, transition and splice of the rope structure of claim 1, the method comprising:

identifying the desired portion of the multi-strand, single-braid rope at the forward end of the rope that will form the braided eye;

without unbraiding all of the strands in the portion of the rope used to form the eye, reverse-orienting each strand of the first plurality of strands rearwardly through the entire portion of the rope used to form the braided eye to help form the splice, each such strand being oriented in the respective distinct tortuous path in the direction of the rear end of the rope;

leaving each strand of the second plurality of strands extending through the entire portion of the rope used to form the braided eye in its respective original tortuous path in the direction of the forward end of the rope, wherein all of the strands are braided together through the entire eye; and tucking the forward end of each strand into the transition in the direction of the rear end of the rope.

12. The method of claim 11 wherein each of the first plurality of strands is reverse-oriented without any other strands being concurrently unbraided or removed from the entire portion of the rope used to form the braided eye.

13. The method of claim 12 wherein each of the first plurality of strands is independently removed from the forward end of the rope through the entire portion of the rope used to form the eye and, starting at the forward end of the rope, returned back into the entire portion of the rope used to form the eye in the respective distinct tortuous path in the direction of the rear end of the rope, all without any other strands being concurrently unbraided or removed from the entire portion of the rope used to form the braided eye, whereby the first plurality of stands are reverse-oriented one at a time through the entire portion of the rope used to form the eye.

14. The method of claim 11 wherein each of the first plurality of strands is reverse-oriented without more than one other strand being concurrently unbraided or removed from the entire portion of the rope used to form the braided eye.

15. The method of claim 11 further including reverse-orienting each of the first plurality of strands into at least substantially the same tortuous path it previously occupied through the entire eye.

* * * * *